US008136660B2

(12) United States Patent
Sharon

(10) Patent No.: US 8,136,660 B2
(45) Date of Patent: Mar. 20, 2012

(54) MULTI COMPARTMENT CONTAINER SYSTEM

(76) Inventor: Igal Sharon, Caesaria (IL)

( * ) Notice: Subject to any disclaimer, the term of this patent is extended or adjusted under 35 U.S.C. 154(b) by 201 days.

(21) Appl. No.: 12/675,132

(22) PCT Filed: Aug. 28, 2008

(86) PCT No.: PCT/IL2008/001172

§ 371 (c)(1),
(2), (4) Date: Feb. 25, 2010

(87) PCT Pub. No.: WO2009/027981

PCT Pub. Date: Mar. 5, 2009

(65) Prior Publication Data

US 2010/0300904 A1 Dec. 2, 2010

(30) Foreign Application Priority Data

Aug. 30, 2007 (IL) ..... 185617

(51) Int. Cl.
*B65D 25/08* (2006.01)

(52) U.S. Cl. ..... 206/221

(58) Field of Classification Search ..... 206/219, 206/221; 215/DIG. 8

See application file for complete search history.

(56) References Cited

U.S. PATENT DOCUMENTS

| | | | | |
|---|---|---|---|---|
| 6,444,174 | B1 * | 9/2002 | Lascombes | 422/554 |
| 7,740,134 | B2 * | 6/2010 | Sweeney et al. | 206/221 |
| 2007/0199839 | A1 * | 8/2007 | Sharon et al. | 206/219 |
| 2007/0246380 | A1 * | 10/2007 | Esteban Villalobos | 206/219 |

* cited by examiner

*Primary Examiner* — Jacob K Ackun
(74) *Attorney, Agent, or Firm* — Deborah Gador

(57) ABSTRACT

A cartridge for use in a multi-compartment system, the cartridge including a housing having an opening at a top end, a sealing wall at a bottom end and wall openings through side walls of the housing; a displaceable sleeve sealingly mounted in the housing, the displaceable sleeve having a sealable filling opening at its top end, and an opening at its bottom end adapted and configured for sealing engagement with the sealing wall; the displaceable sleeve being axially displaceable between two positions along a longitudinal axis through the cartridge, a first position whereby the displaceable sleeve is in sealing engagement with the sealing wall and a seal is formed, and a second position where the sealing wall and the displaceable sleeve are disengaged, providing flow communication through the wall openings.

18 Claims, 21 Drawing Sheets

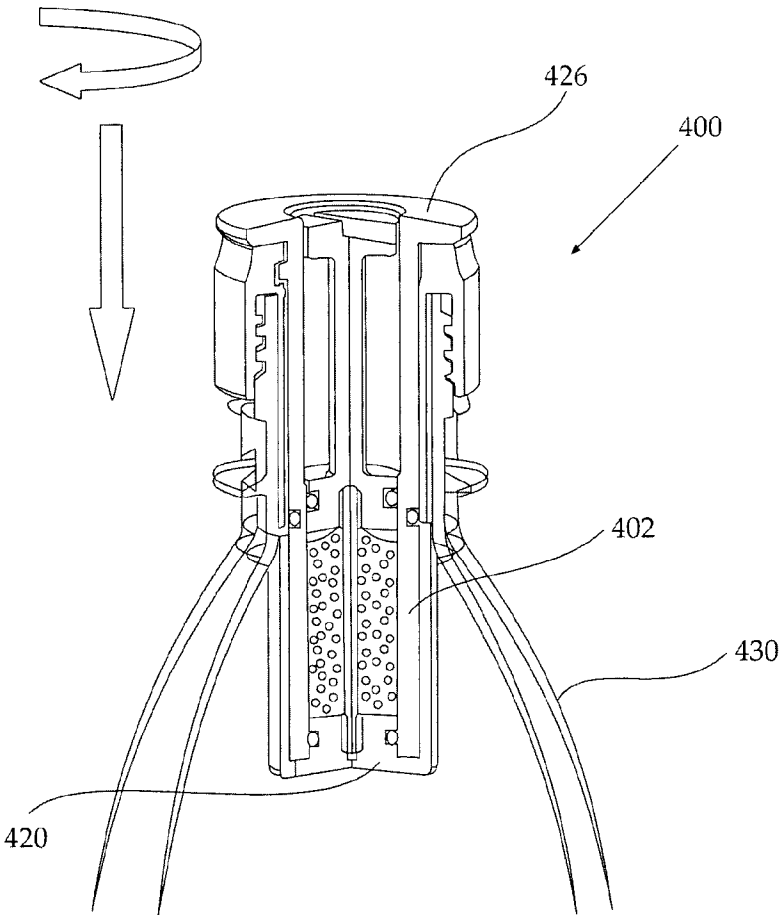
FIG.10
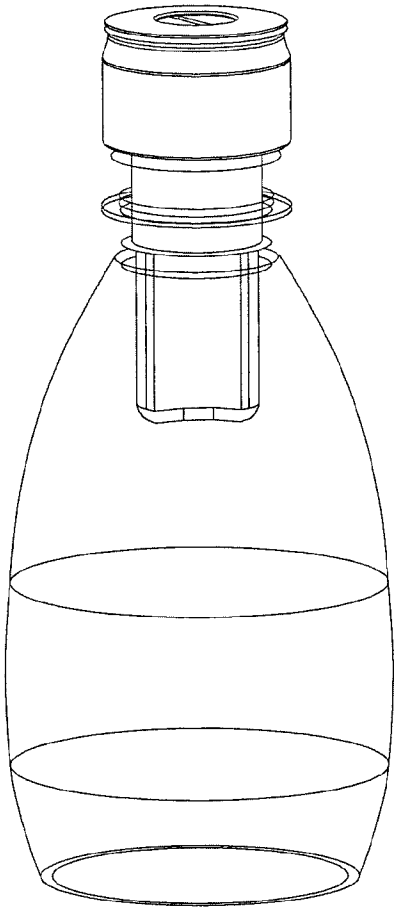

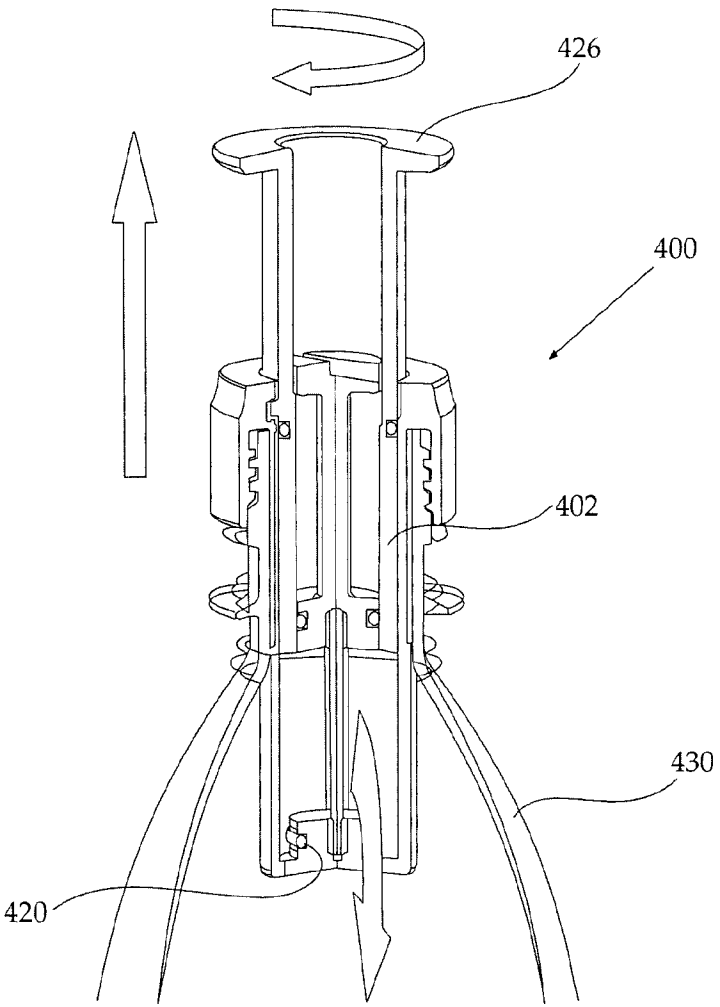
FIG.11
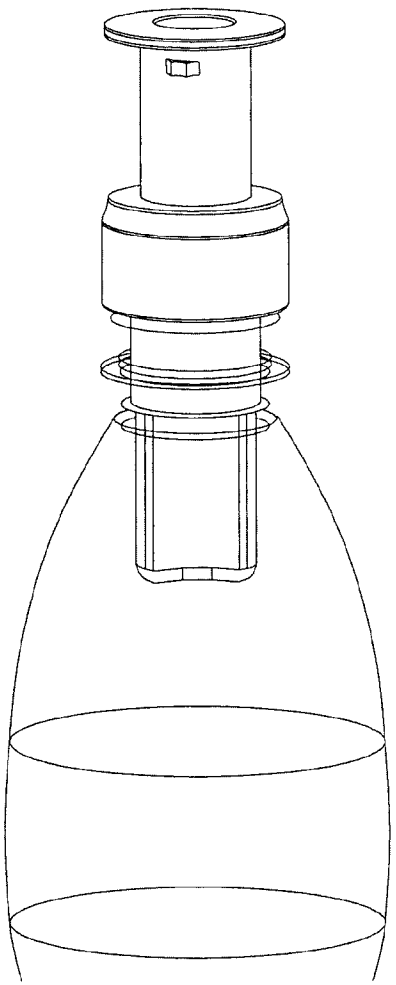

MULTI COMPARTMENT CONTAINER SYSTEM

FIELD OF THE INVENTION

This invention relates to an improved multi-compartment system for storing each of two or more components of a formulation separately in individual containers until ready for mixing prior to use.

BACKGROUND OF THE INVENTION

The improved container assembly system of the present invention provides a container system that allows the user to store multiple components of a formulation in separate individual containers that can be assembled easily into a single multi-compartment container which can store the multiple components separated until they are ready for use, at which time the components may be mixed to form the formulation, just prior to use. The improved container system according to the present invention may consist of two basic types of assembly units: a dispensing unit, and a cartridge unit. Each of these units is a separate container that may be assembled together readily to form a single multi-compartment container, with each of the assembly units forming a separate compartment.

It is known to store a variety of formulations for human use in the form of a dry powder which is mixed with a liquid to form a liquid formulation shortly before use. This is the case, for example, with various nutritive formulas and a variety of drugs, e.g. antibiotics. The shelf life of such mixed liquid formulations is limited, and this dictates the need to prepare it into a liquid form only shortly before use. The limited shelf life of the liquid formulation is a result of a loss of activity of an active ingredient in the formula, accelerated oxidation once in solution, etc.

A multi-compartment container assembly system that allows the user to store multiple components of a formulation in separate individually sealed containers that can be assembled into a single multi-compartment container is disclosed in U.S. Pat. Nos. 6,959,807 and 7,083,043. The container assembly systems consist of two or more assembly units, at least one of which is a cartridge unit and the other may be another cartridge unit or a dispensing unit. These assembly units can be individually sealed so that a component of a formulation may be stored in each of the assembly units. The assembly units can then be assembled into a single multi-compartment container by joining an appropriate number of assembly units together. In other words, each of the assembly units are separate sealable containers that may be assembled together readily to form a single multi-compartment container with each of the assembly units forming a separate compartment so that the components of the formulation can be kept separated until ready to be mixed.

For example, a dispensing unit and a cartridge unit may be assembled together to form a two-compartment container assembly. And by piggy-backing one or more cartridge units to the first cartridge unit in series, additional compartments may be added. Each additional cartridge unit may contain a different component of a formulation in any predetermined quantity. Furthermore, a multi-compartment container may be assembled by connecting multiple cartridge units only without using any dispensing unit. In such embodiment, a suitable dispensing device may be attached to the top opening of the first cartridge unit, if necessary.

A dispensing unit may be a container for storing a component of a formulation with an opening at each end of the container body. The top end of the dispensing unit may be adapted and configured to engage a dispensing device such as a nozzle or a nipple of a suitable material for a baby feeding bottle, or a dosage device, etc. The bottom end of the dispensing unit may be adapted and configured to engage a cartridge unit, in order to assemble a multi-compartment container. The cartridge unit may be adapted and configured to engage the top or bottom ends of the dispensing unit.

Both ends of the dispensing unit may be sealed, so that the dispensing unit content can be protected from any contamination during storage. But because these seals must be removed in order to assemble the multi-compartment assembly and dispense the contents, the seals are preferably configured to be readily removed or broken, e.g., a breakable or peelable seal. The breakable or peelable seal may comprise a membrane, where the membrane may be a foil or a non-metallic membrane, such as a plastic or other polymer membrane, and may have a single-layer or a multi-layered laminate structure. Such membrane seal may be heat sealed along the rims of the dispensing units open ends so that it may be peeled off to engage a cartridge unit or to attach an appropriate dispensing system. The seal may further comprise a screw-on or pressure closing cap.

A cartridge unit is another container for storing another component of the formulation with an opening at each of its top and bottom ends. The top open end of the cartridge unit may be adapted and configured to sealingly engage the bottom opening of the dispensing unit forming a two-compartment container. To form a two-compartment container, the top end of the cartridge unit is inserted into the flange portion of the dispensing unit, whereby each assembly unit forms a separate compartment of the resulting container.

Within the cartridge unit is provided a sealing wall that forms a fluid-tight seal at or near the top open end of the cartridge unit, sealing the top end opening. The sealing wall is axially movable, i.e., along the longitudinal axis of the cartridge unit, between a sealed position, whereby the seal is formed, and an unsealed position, whereby the inside of the cartridge unit is in flow-communication with the dispensing unit through the top open end. The cartridge unit further may be provided with a displaceable member for axially moving the sealing wall between its sealed position and its unsealed position.

The displaceable member has the sealing wall at its top end and a sealable filling opening near its bottom open end. Additional cartridge units may be piggy-backed to the bottom end of the displaceable member, in series, to form a multi-compartment container. In this configuration, the bottom end of the displaceable member of the first cartridge unit and the top end of the second cartridge unit engage each other to form a fluid-tight seal, so that each cartridge unit may form a compartment of a multi-compartment container.

One concern with such multi-compartment container assembly systems is that the flow-communication between the cartridge unit and the dispensing unit through the top open end of the cartridge unit may not provide for sufficient contact surface between the component in the first assembly unit and the component in the second assembly unit. Thus, the two components of the formulation may not mix thoroughly or quickly. Such a problem is of particular concern where at least one of the components is a viscous, non-free flowing component, or where a powdered component does not dissolve sufficiently rapidly and sticks to its original assembly unit.

Accordingly, there is a long felt need for a multi-compartment container assembly system that maximizes surface area of contact between the components stored in the assembly units when the container assembly is in the unsealed position. It would be very desirable to have a cartridge unit that permits the components stored in the multi-compartment container to mix swiftly and efficiently with one another before dispensing.

SUMMARY OF THE INVENTION

Accordingly, there is provided, according to the present invention, a cartridge for use in a multi-compartment system, the cartridge including a housing having an opening at a top end, a sealing wall at a bottom end and wall openings through side walls of the housing and a displaceable sleeve sealingly mounted in the housing, the displaceable sleeve having a sealable filling opening at its top end, and an opening at its bottom end adapted and configured for sealing engagement with the sealing wall. The displaceable sleeve is axially displaceable between two positions along a longitudinal axis through the cartridge, a first position whereby the displaceable sleeve is in sealing engagement with the sealing wall and a seal is formed, and a second position where the sealing wall and the displaceable sleeve are disengaged, providing flow communication through the wall openings.

According to a preferred embodiment of the invention, both the housing and the sleeve are substantially cylindrical.

According to another embodiment of the invention, there is provided a multi-compartment system for storing and mixing two components of a mixture and mixing the components prior to use, the system including at least two containers, at least one of the containers being a cartridge, where the cartridge includes a housing having an opening at a top end, a sealing wall at a bottom end and wall openings through side walls of the housing, the cartridge being adapted and configured to engage and seal the second container and a displaceable sleeve sealingly mounted in the housing, the displaceable sleeve having a sealable filling opening at its top end, and an opening at its bottom end being adapted and configured for a sealing engagement with the sealing wall, so as to define a compartment in the cartridge. The displaceable sleeve is axially displaceable between two positions along a longitudinal axis through the cartridge, a first position wherein the displaceable sleeve is in sealing engagement with the sealing wall and a seal is formed, and a second position wherein the sealing wall and the displaceable sleeve are disengaged, whereby the compartment inside the cartridge is in flow communication with a compartment in the second container through the wall openings.

Further according to the invention, there is provided a multi-compartment container system including at least three containers, at least two of which are cartridges, as described above. In one embodiment, one cartridge is mounted on each open end of a third container. In another embodiment, one cartridge is mounted on a second cartridge which, in turn, is mounted on a third container.

There is also provided, according to the invention, a method for forming a multi-compartment system for storing and mixing two components of a mixture and mixing the components prior to use, the method including providing at least two containers, wherein at least one of the containers is a cartridge, and coupling the cartridge to a second of the at least two containers. The cartridge is formed by providing a housing having a sealable opening at a top end, a sealing wall at a bottom end and wall openings through side walls of the housing; slideably mounting a displaceable sleeve in the housing, the displaceable sleeve having a sealable filling opening at its top end, and an opening at its bottom end adapted and configured for sealing engagement with the sealing wall; and disposing the displaceable sleeve for axial displacement between two positions along a longitudinal axis through the cartridge, a first position wherein the displaceable sleeve is in sealing engagement with the sealing wall and a seal is formed, thereby defining a compartment inside the cartridge, and a second position where the sealing wall and the displaceable sleeve are disengaged, whereby the compartment inside the cartridge is in flow communication with a compartment in the second container through the wall openings.

According to a preferred embodiment, the method further includes inserting at least part of the cartridge into the second container, the cartridge being adapted and configured to engage and seal the second container when at least the wall openings of the housing are inside the compartment defined by the second container.

There is further provided, according to the present invention, a cartridge for use in a multi-compartment system, the cartridge including a housing having an opening at a top end, a sealing wall at a bottom end and wall openings through side walls of the housing, a displaceable sleeve sealingly mounted in the housing, the displaceable sleeve having a sealable filling opening at its top end, and a detachable seal at its bottom end adapted and configured for fixed engagement with the sealing wall, the displaceable sleeve being axially displaceable between two positions along a longitudinal axis through the cartridge, a first position whereby the detachable seal is fixedly engaged with the sealing wall, and a second position where the detachable seal is detached from the displaceable sleeve, permitting flow communication through the wall openings.

BRIEF DESCRIPTION OF THE DRAWINGS

The present invention will be further understood and appreciated from the following detailed description taken in conjunction with the drawings in which:

FIG. 10 is a partial cutaway view of the cartridge unit of FIGS. 7*a* and 7*b* as assembled and capping a dispensing unit, in a sealing orientation;

FIG. 11 is a partial cutaway view of the cartridge unit of FIGS. 7*a* and 7*b* in a flow communication orientation;

The drawings are only schematic and are not necessarily to scale.

DETAILED DESCRIPTION OF THE INVENTION

The present invention relates to a novel cartridge and a multi-compartment container system including such a cartridge, for storing components of a mixture until ready for mixing, just prior to use, providing, during the mixing state, an increased contact between the components in the different compartments for more rapid and thorough mixing. This is accomplished by utilizing a cartridge having a housing defining a sealing wall surrounded by a plurality of wall openings in side walls of the housing, and a displaceable sleeve adapted for sealable insertion into the housing and for selective sealing by the sealing wall to form a compartment in the cartridge. The cartridge is adapted to be inserted into the compartment defined by a dispensing unit in the multi-compartment system.

Some examples of the multi-compartment containers including such a cartridge are provided to illustrate various specific configurations and examples of the invention. However, the invention should not be regarded as being limited to these embodiments. The containers may also be used for different uses, e.g., two or more compartment containers for medicinal formulations, dietary powders to be reconstituted with a liquid, alcoholic beverages to form cocktails with other ingredients or various non-alcoholic beverages that are prepared from powders, wherein one compartment contains one component and the other compartment contains another component to be mixed to form a formulation, or measuring doses of a pre-selected volume from a larger volume.

Figure 1A:
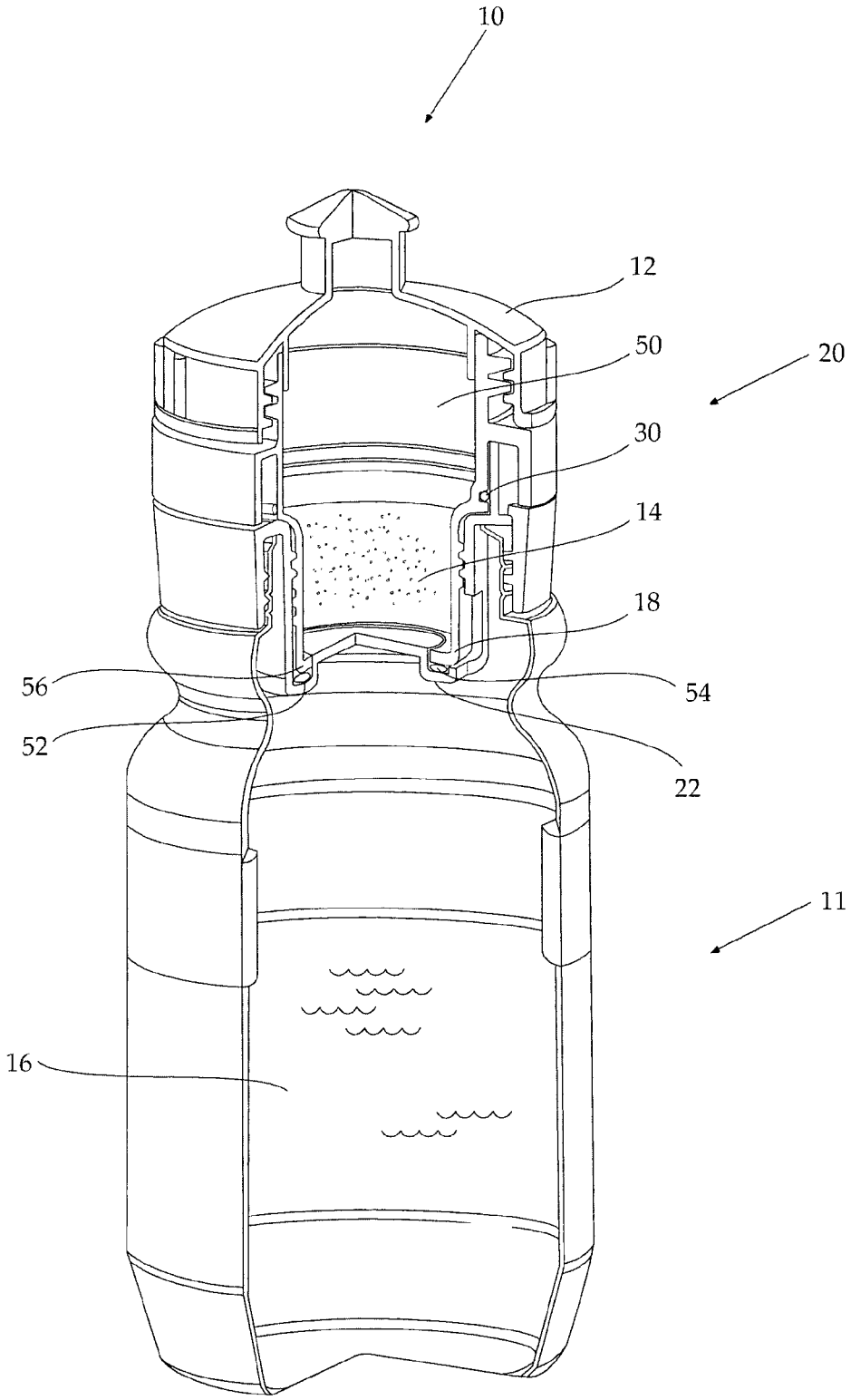
FIG. 1*a* is a partial cut away perspective view of a two-compartment container system according to an embodiment of the invention, in a sealing orientation.
Figure 1B:
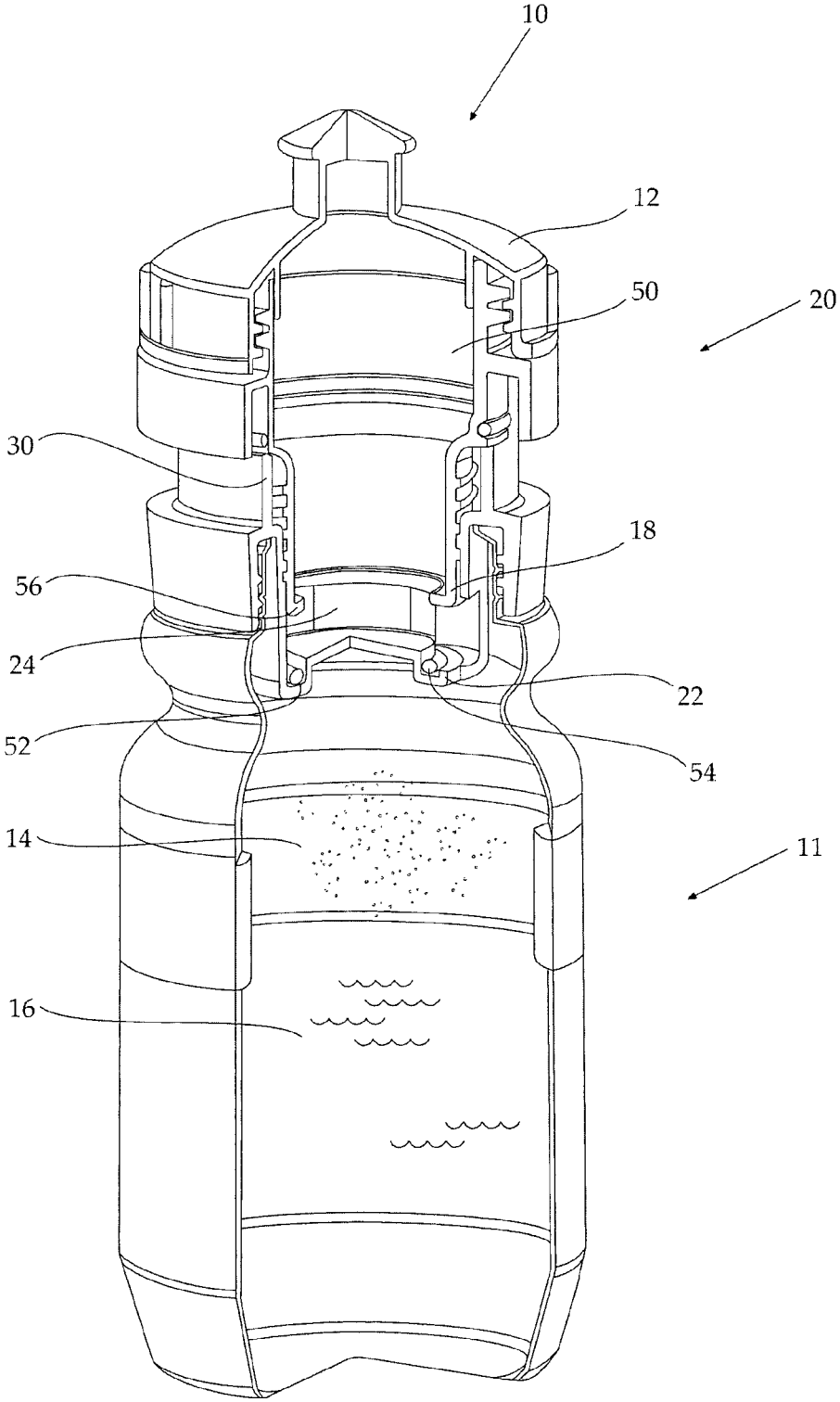
FIG. 1*b* is a partial cut away perspective view of the two-compartment container system of FIG. 1*a* in a flow communication orientation.

FIGS. 1*a* and 1*b* are partial cut away perspective views illustrating a two-compartment container assembly 10 constructed and operative according to one embodiment of the present invention. The two-compartment container 10 is assembled from two assembly units: a dispensing unit 11 and a cartridge unit 20. Each of these assembly units is an individually sealable container that may be filled with a component of a formulation that may be sealed and stored therein.

Cartridge 20 includes a displaceable sleeve 18 and a housing 30, defining a sealing wall 22 and a plurality of wall openings 24 through its side walls. Displaceable sleeve 18 is sealingly inserted in housing 30 and selectively sealingly engages sealing wall 22.

FIG. 1*a* illustrates the two-compartment container assembly 10 in a sealing orientation, wherein there is no flow communication between the interior of the dispensing unit 11 and the cartridge 20. Cartridge 20 can be filled with a component 14 to be mixed with a component 16 in dispensing unit 11. Cartridge 20 is then sealingly mounted on dispensing unit 11, such that at least part of the housing 30 is inserted into the compartment holding component 16 defined by dispensing unit 11, and closed with cap 12, as shown in FIG. 1*a*. As further illustrated in FIG. 1*a*, a displaceable sleeve 18 sealingly engages a sealing wall 22, in order to seal cartridge 20 and keep the two-compartment container 10 in a sealing orientation. The sealing wall is surrounded by a plurality of openings 24 in the housing walls permitting profuse contact between component 14 and component 16, during the state of mixing in the multi-compartment container system.

When it is desired to combine the two components 14 and 16, generally just prior to dispensing, displaceable sleeve 18 in cartridge 20 is displaced away from sealing wall 22 to provide a flow communication with dispensing unit 11 through wall openings 24, thus permitting the mixing of component 14 in cartridge 20 with component 16 in dispensing unit 11, as shown in FIG. 1*b*. Preferably, wall openings 24 extend substantially from sealing wall 22, so as to provide a large contact surface for mixing between components 14 and 16 as soon as the sleeve disengages from the sealing wall. It will be appreciated that displaceable sleeve 18 can be moved relative to sealing wall 22 by rotation, pushing and pulling, or in any other fashion.

Figure 2:
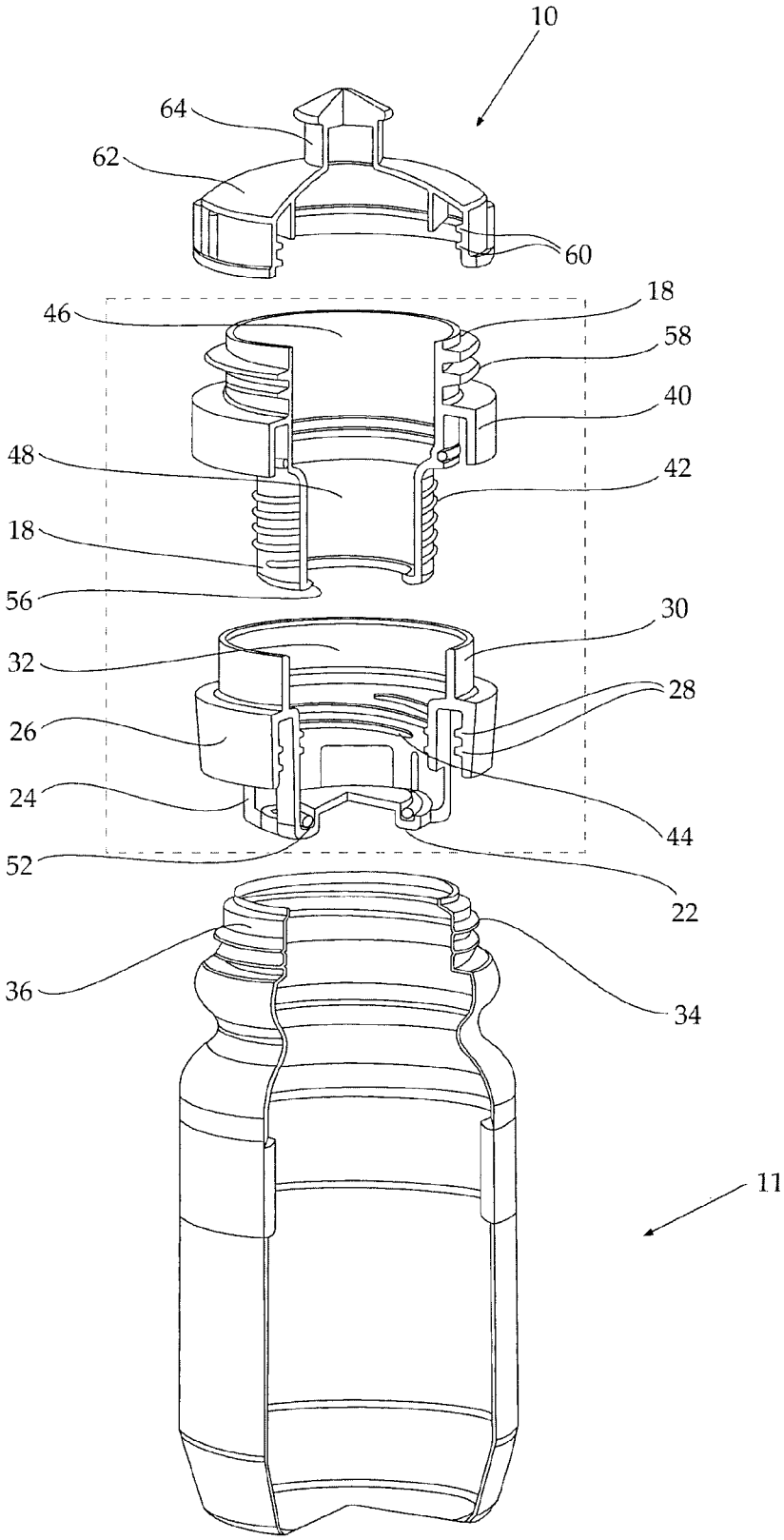
FIG. 2 is an exploded partial cut away perspective view of the two-compartment container system of FIGS. 1*a* and 1*b;*

Referring now to FIG. 2, there is shown an exploded partial cut away view of two-compartment container assembly 10. Cartridge 20 comprises two parts: a housing 30 and a displaceable sleeve 18. Housing 30 is substantially cylindrical and includes a top end opening 32, a sealing wall 22 at its bottom end, and a plurality of side walls openings 24 at the lower portion of housing 30. An annular depending skirt 26 extends downwardly from housing 30, and is provided with screw threads 28 for a threaded engagement with complementary threads 34 on the external surface of neck 36 of dispensing unit 11. Displaceable sleeve 18 is provided with external screw threads 42 for mounting displaceable sleeve 18 in housing 30, by threadably engaging complementary threads 44 on the internal surface of housing 30. The displaceable sleeve 18 has a top end opening 46 and a bottom end opening 48. Displaceable sleeve 18 is adapted and configured for sealing engagement of its bottom end opening 48 with sealing wall 22 at the bottom end of housing 30, as well as for sealing displacement through housing 30.

Housing 30 and displaceable sleeve 18 define a compartment 50 (see FIGS. 1*a* and 1*b*) in cartridge 20 that is disposed partially inside dispensing unit 11 through neck 36. When displaceable sleeve 18 sealingly engages sealing wall 22 at the bottom end of housing 30, sleeve 18 and sealing wall 22 at least partially define a contained volume for storing a component 14 of a mixture until ready for mixing, just prior to use. According to an embodiment of the present invention, sealing wall 22 includes a circumferential groove 52 for receiving an O-ring seal 54 (illustrated in FIGS. 1*a* and 1*b*). A circumferential flange 56 is provided at the bottom end of displaceable sleeve 18. Flange 56 is adapted for a sealing engagement with seal 54 when container assembly 10 is in the sealing orientation. The compartment 50 can hold any desired component of a mixture which will later be mixed with component 16 in dispensing unit 11, and can include a free flowing powder, a solid or a viscous or pasty compound.

Skirt 26 depending from housing 30 engages neck 36 at the top end of dispensing unit 11 when the two units are assembled into a two-compartment container 10. The diameters of skirt 26 and neck 36 are such that they preferably engage to form a fluid-tight seal. In this illustrated example, the skirt 26 has a larger diameter than neck 36 and it fits over the neck 36. But, the dispensing unit 11 and the cartridge unit 20 may be configured with many other varieties of structures to sealingly engage one another to form a fluid-tight seal. The mating surfaces of the skirt 26 and the neck 36 may be provided with raised sealing ridges that produce friction-fitted seal at the mating interface. Alternatively, at least one of the mating surfaces may be provided with elastomeric seals to form compression seal at the mating interface. Alternatively, skirt 26 and neck 36 may be adapted and configured for sealing snap-fitting engagement.

The top end of the dispensing unit 11 is sealed with a sealing member (not shown) and the bottom end of the cartridge unit 20 is sealed with displaceable sleeve 18 and sealing wall 22. According to the present invention, the sealing member on dispensing unit 11 is removed prior to mounting cartridge 20 on, and at least partially in, dispensing unit 11. When the displaceable sleeve 18 is axially displaced upwardly the bottom end opening of the cartridge unit 20 is unsealed. In the illustrated embodiment, displaceable sleeve 18 further includes an annular flange 40, adapted and configured to be controlled by a user to move the displaceable sleeve axially through housing 30, serving as an externally accessible manipulable portion of the cartridge.

The external surface of the upper portion of sleeve 18 is preferably provided with screw threads 58 for threadably engaging complementary screw threads 60 on the internal surface of a closure member 62, for example, a cap which may include a dispensing spout 64 for dispensing the mixture formed inside container system 10. Closure member 62 may further include a seal 66 for preventing inadvertent dispensing. It will be appreciated that closure member 62 may alternatively include a beaded lip, that produces a friction-fitting connection with complementary screw threads 58 to couple the closure member to sleeve 18. It will be appreciated that the external surface of the lower portion of displaceable sleeve 18 and the internal surface of housing 30 may be adapted and configured to form a friction-fitting sliding engagement for displacing the sleeve in the housing by pulling or pushing.

Figure 3A:
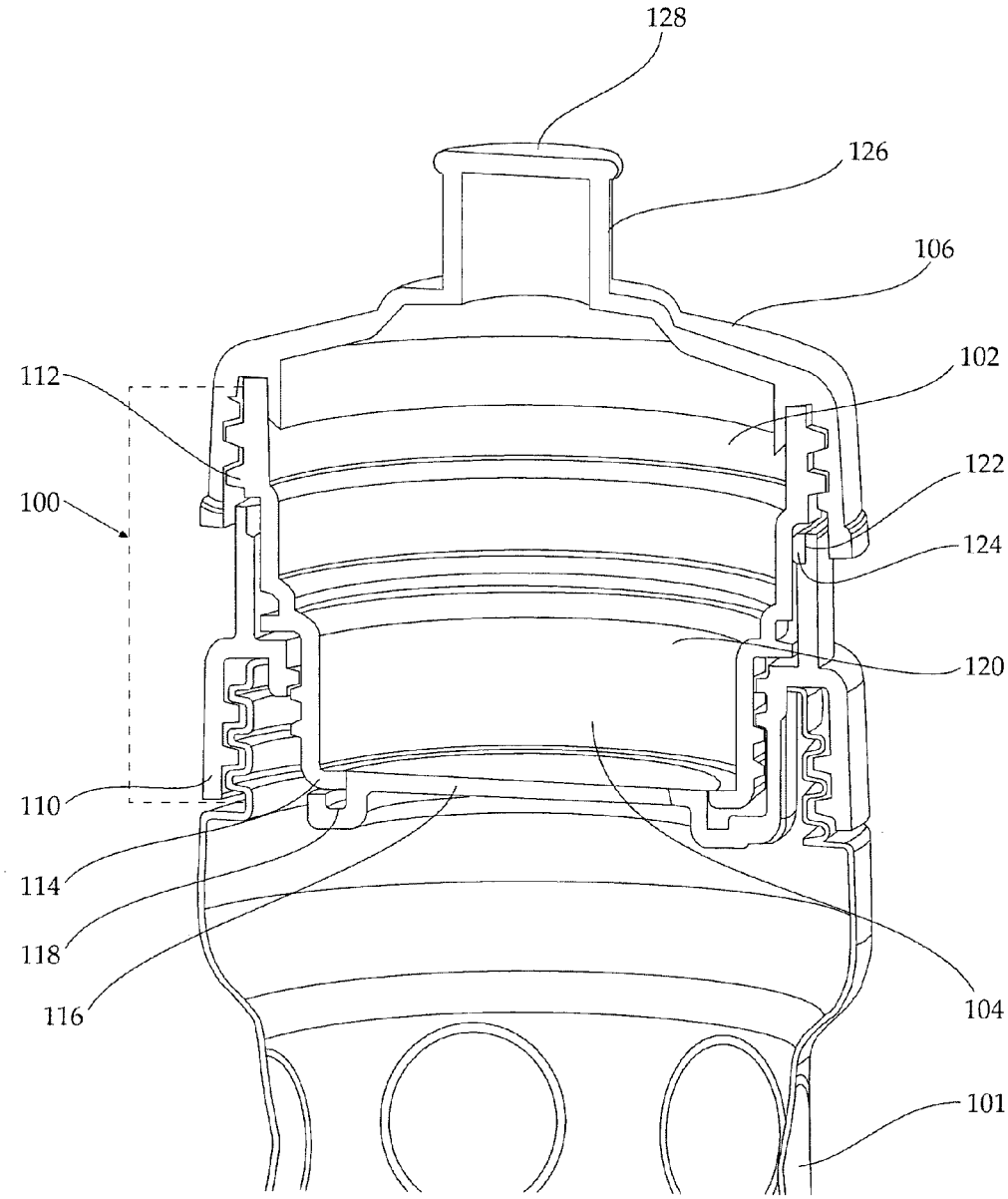
FIG. 3*a* is a partially cut away perspective view of a cartridge unit constructed and operative in accordance with a preferred embodiment of the present invention, in a sealing orientation.
Figure 3B:
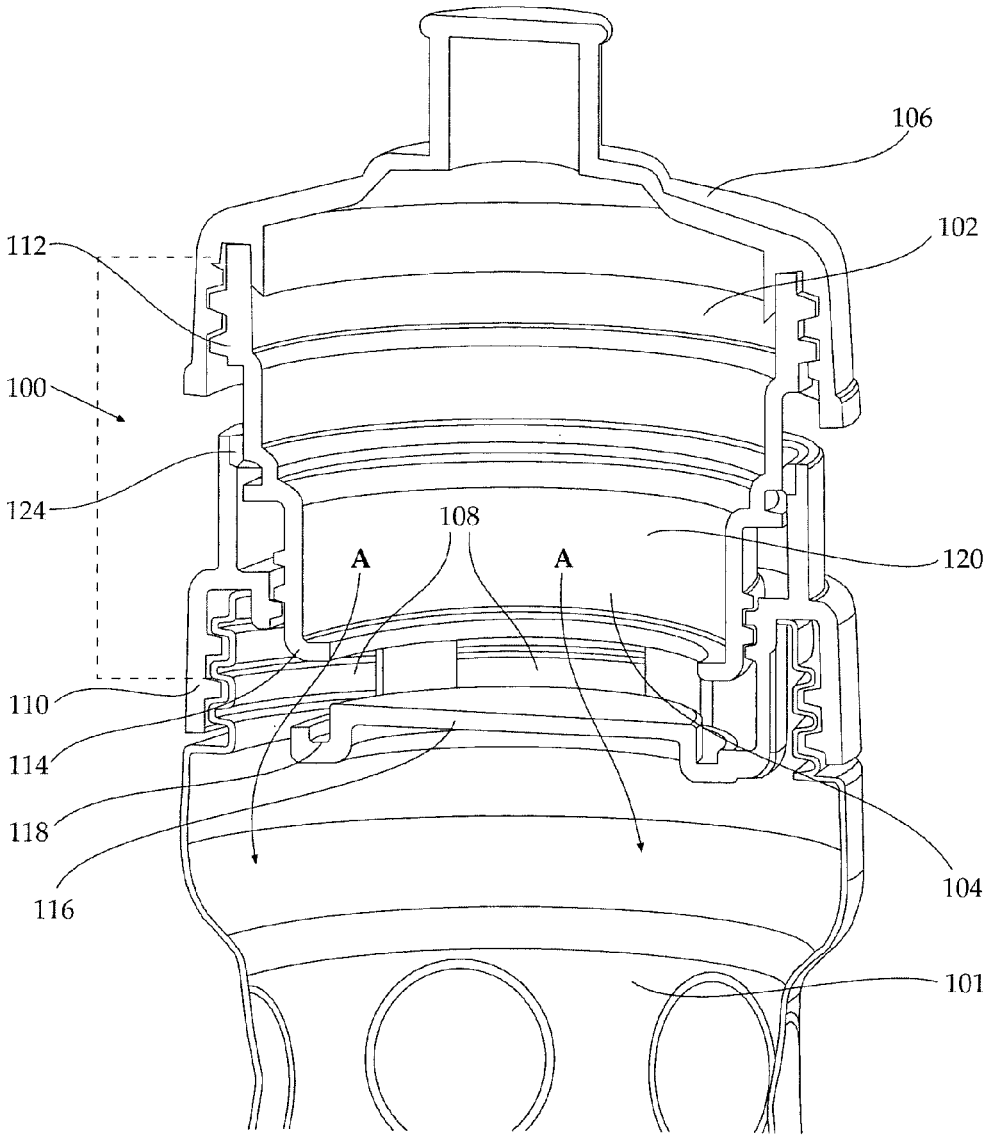
FIG. 3*b* is a partially cut away perspective view of the cartridge unit of FIG. 3*a* in a flow communication orientation.

FIGS. 3*a* and 3*b* are partial cutaway perspective views of a cartridge unit 100 in more detail, in a sealed and an unsealed orientation, respectively. Cartridge unit 100 may be engaged with a dispensing unit 101 to form a two-compartment container. The cartridge unit 100 has two openings: a top opening 102 and a bottom opening 104. The top opening 102 is defined by a displaceable sleeve 112 sealingly disposed in a housing 110. The displaceable sleeve 112 is normally situated within cartridge unit housing 110 and is axially displaceable within housing 110 between a sealed position and an unsealed position. Preferably, the internal wall of the top portion of housing 110 is provided with a circumferential recess 122 for seating an o-ring seal 124. This arrangement provides a liquid-tight seal for sealed sliding engagement between the external wall surface of displaceable sleeve 112 and housing 110. In this way, the mixture held in the two-compartment container assembly 100 does not leak when displaceable sleeve 106 is in the unsealed or sealed position. It will be appreciated that a sealing ridge, fabricated of elastomeric material to enhance sealing, which is preferably air-permeable, coupled to the internal wall of housing 110, can be used instead of the sealing arrangement of recess 122 an o-ring seal 124. The o-ring 118 or the sealing ridge also acts to stabilize the movement of displaceable sleeve 106 during relative movement between the sleeve and the housing, i.e., unsealing or re-sealing, preventing the displaceable sleeve 106 from wobbling with respect to the longitudinal axis of the cartridge.

The lower walls of displaceable sleeve 112 define a circumferential flange 114 adapted and configured for sealing engagement with a sealing wall 116 at the bottom end of housing 110 to seal the bottom opening 104 of the cartridge unit 100. A plurality of side wall openings 108 (seen in FIG. 3*b*) are defined in the side walls of the lower portion of housing 110. These side wall openings may be blocked when displaceable sleeve 112 is in the sealed orientation of FIG. 3*a* and are exposed as soon as displaceable sleeve 112 disengages from sealing wall 116. As illustrated in FIG. 3*a*, flange 114 sealingly engages sealing wall 116 so as to provide a bottom seal to compartment 120, thus cartridge unit 100 is in a sealed orientation. It will be appreciated that the sealing engagement of displaceable sleeve 112 and sealing wall 116 seals the bottom portion of cartridge unit 100 irrespective of whether side wall openings 108 are sealed by displaceable sleeve 112. Thus, housing 110 and displaceable sleeve 112 define a compartment 120 within cartridge unit 100. Preferably, the sealing wall 116 includes a circumferential groove 118 for holding an o-ring seal (not shown) configured to engage flange 114 and form a fluid-tight seal. The top opening 102 may be sealed with a top closure member 106. Preferably, the seal formed at the top opening 102 by the closure member 106 is also fluid-tight, so that compartment 120 of the cartridge unit may be filled with either liquid or solid substances. This arrangement also protects the contents of the cartridge unit from contamination during storage. The closure member 106 may be a screw cap, a friction fitting plug, a snap-fitting plug, a heat-sealed membrane, or another variety of closure methods that would be obvious to one of ordinary skill in the art.

In FIG. 3*b*, the displaceable sleeve 112 has been axially displaced within housing 110 from a sealed position to an unsealed position. In its unsealed position, the displaceable sleeve 112 is axially displaced away from sealing wall 116, leaving side wall openings 108, open thus providing flow communication passages A between compartment 120 and the internal space of the dispensing unit 101. The flow communication allows mixing of a component in cartridge unit 100 with a component in dispensing unit 101 to form a mixture which is ready for dispensing.

It will be appreciated that the axial displacement of displaceable sleeve 112 can be achieved by rotating closure member 106 in the tightening direction of the cap when the displaceable sleeve and the housing are threadably engaged or by pulling closure member 106 when the portion of engagement of the displaceable sleeve and the housing are not threaded and they are frictionally engaged. Alternatively, displaceable sleeve 112 can be axially displaced between the sealed position and the unsealed position and from the unsealed position back to the sealed position, in any other suitable manner, e.g., by turning clockwise or counter clockwise, or pulling or pushing closure member 106. As stated above, side wall openings 108 provide spaces that allow compartment 120 to communicate with the internal environment of dispensing unit 101 when the displaceable sleeve 112 is in the unsealed position. It is a particular feature of the present invention that the side wall openings 108 of cartridge unit 100 are disposed inside dispensing unit 101 when the two units are engaged to form a two-compartment container. This arrangement maximizes surface contact between the components stored in dispensing unit 101 and cartridge unit 100 when the container assembly is in the unsealed position. Due to the extensive contact provided by flow-communication passages A, it would be obvious to one of ordinary skill in the art that even viscous or pasty components, and particularly powdered components, placed in compartment 120 will speedily and thoroughly mix with a liquid present in dispensing unit 101.

Sealing wall 116 may be substantially flat, while the lower portion of the walls of displaceable sleeve 112 may directly and sealingly engage sealing wall 116, to form a liquid-tight seal between compartment 120 and the dispensing unit 101. In the unsealed position, the contents of the dispensing unit and the contents of the cartridge unit flow through walls openings 116 which form flow passages A and mix rapidly and thoroughly. When the contents of the cartridge are viscous or pasty, it is preferred that walls openings 108 provide the largest possible surface area contact, to prevent sticking. In the sealed position (as illustrated in FIG. 3*a*) the cartridge unit can be filled by removing closure member 106 or through a spout 126 in the closure member, as after removing a seal 128 from the spout.

Figure 4A:
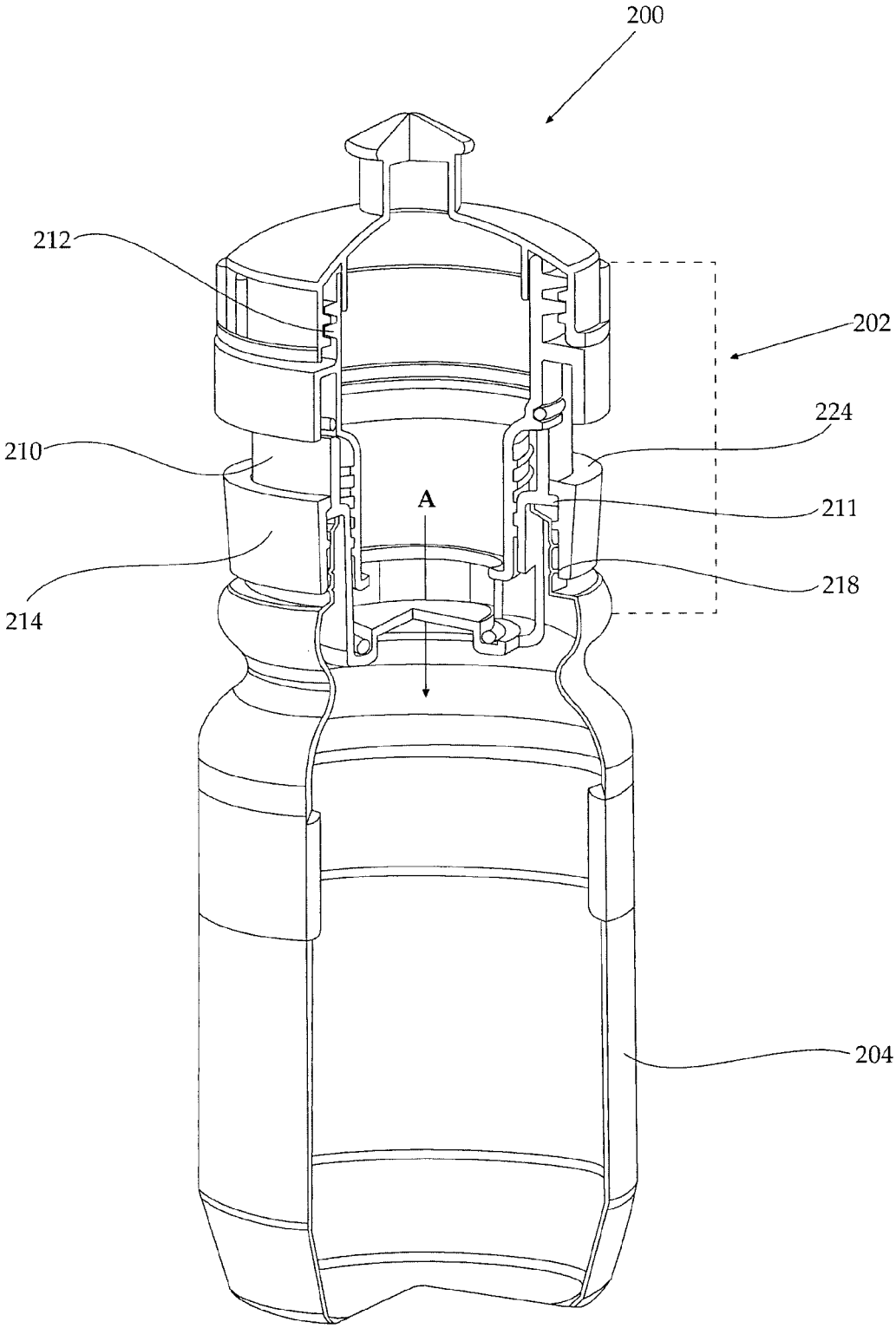
FIG. 4*a* is a partial cut away perspective view of a two-compartment container system constructed and operative in accordance with another preferred embodiment of the present invention.
Figure 4B:
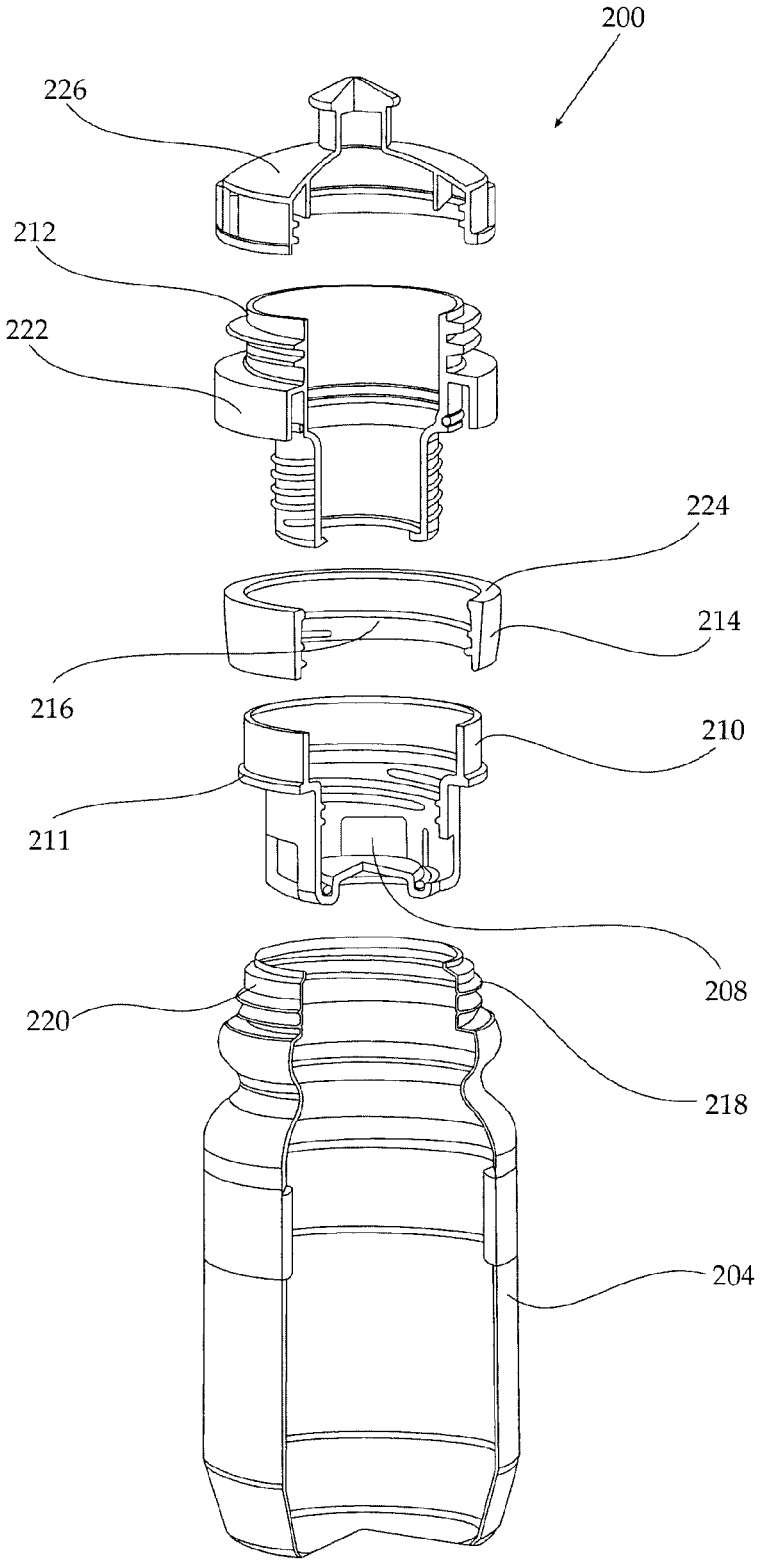
FIG. 4*b* is an exploded partial cut away perspective view of the two-compartment container system of FIG. 4*a*.

FIG. 4*a* is a partial cut away perspective view of a two-compartment container system, constructed and operative in accordance with a preferred embodiment of the present invention, in the unsealed orientation, and FIG. 4*b* is an exploded partial cut away perspective view of the two-compartment container assembly of FIG. 4*a*.

The two-compartment container assembly 200 illustrated in FIGS. 4*a* and 4*b*, includes a cartridge unit 202 having a substantially cylindrical housing 210 and a substantially cylindrical displaceable sleeve 212. Housing 210 is disposed in a dispensing unit 204, constructed and operative according to one embodiment of the present invention. The diameter of the lower portion of housing 210 is slightly smaller than the diameter of the neck portion 220 of dispensing unit 204 and configured to be inserted into the dispensing unit during assembly. The diameter of the upper portion of housing 210 is slightly larger than the diameter of the neck portion 220 of dispensing unit 204. Thus, it abuts against the rim of dispensing unit 204 when inserted into the dispensing unit. Displaceable sleeve 212 is axially displaceable between two positions along a longitudinal axis through cartridge unit 202, a first position whereby a seal is formed preventing a component stored in cartridge unit 202 from coming in contact with a component stored in dispensing unit 204, and a second position where sealable flow passages A are open allowing the two components separately stored in the two assembly units cartridge to mix.

The two-compartment container assembly illustrated in FIGS. 4*a* and 4*b* further includes a securing ring 214 provided with screw threads 216 for securing housing 210 to dispensing unit 204, by engaging a protruding rim 211 about housing 210 and complementary screw threads 218 on neck portion 220 of dispensing unit 204. Securing ring 214 includes an annular shoulder 224 defining the top end opening of securing ring 214. Shoulder 224 is configured to abut against the protruding rim 211 of housing 210, for securing housing 210 in dispensing unit 204.

The diameter of ring 214 is slightly larger than the diameter of the top rim of housing 210. Thus it can slide over the top portion of housing 210 and threadably engage neck portion 220 of dispensing unit 204. It will be appreciated that, alternatively, ring 214 can be configured for friction-fitting connection with the neck of dispensing unit 201.

The displaceable sleeve 212 has an annular user manipulable portion 222 for axially displacing the displaceable sleeve 212 between the sealed position and the unsealed position and vice versa.

When the two-compartment container assembly 200 is assembled, the bottom end of housing 210 with sealing wall 224 and side wall openings 208 is inserted into dispensing unit 204 through neck portion 220. Securing ring 214 is placed over the top portion of housing 210 and is coupled to the neck portion 220 to secure housing 210 to dispensing unit 204. Then, displaceable sleeve 212 is threadably inserted through ring 214 into housing 210 for sealing engagement with the housing. A closure member 226 is coupled to the top open end of displaceable sleeve 212, to seal the cartridge unit 202.

Figure 5A:
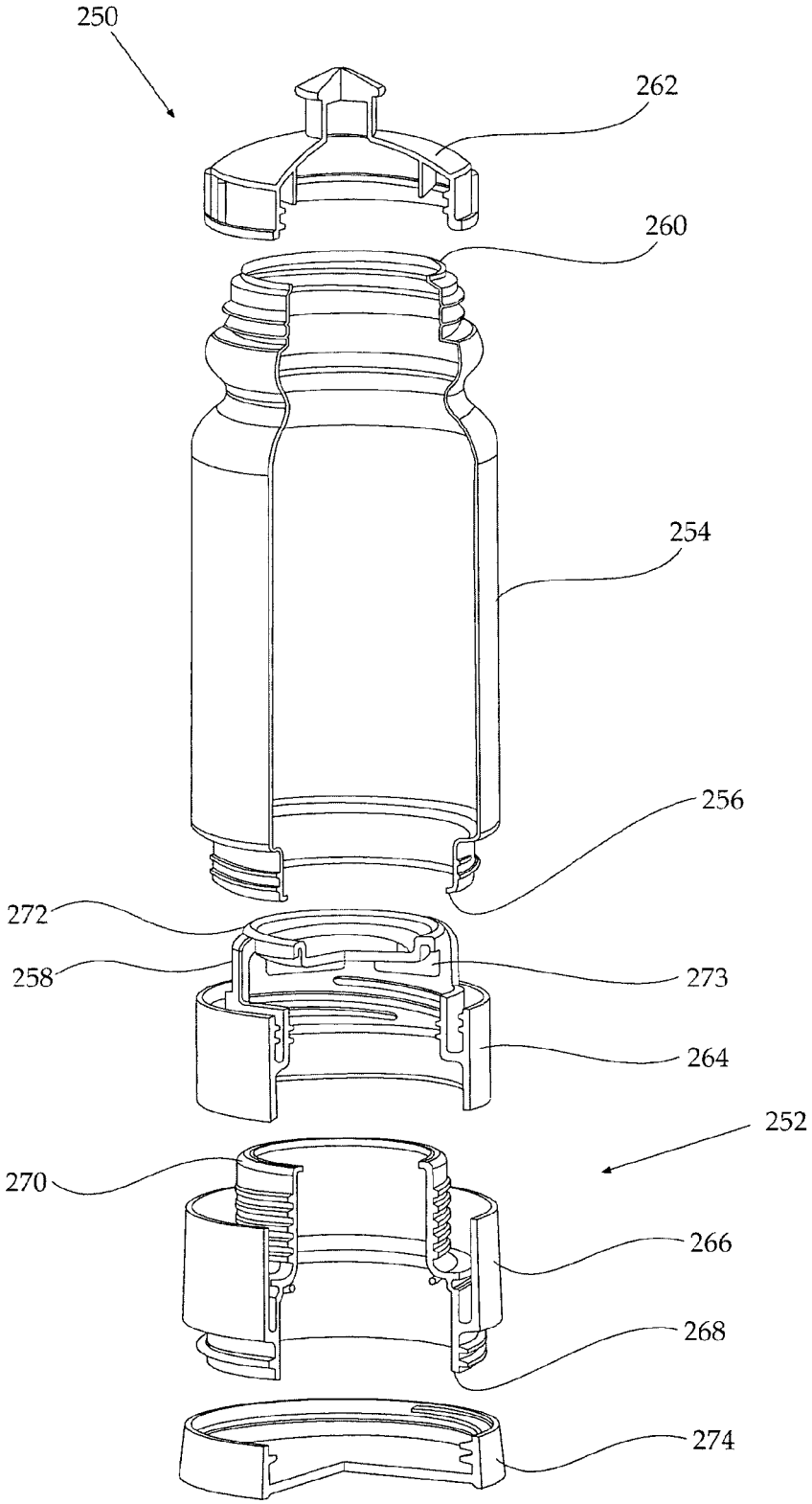
FIG. 5*a* is an exploded partial cut away perspective view of the two-compartment container system according to an embodiment of the invention.

FIG. 5*a* illustrates an exploded, partial cut away view of a two-compartment container assembly 250 according to another embodiment of the invention. Container assembly 250 includes a cartridge unit 252 and a dispensing unit 254. Dispensing unit 254 includes sealable openings at its top and bottom ends. The top open end rim 260 of dispensing unit 254 engages a first closure member 262 for sealing the top end of dispensing unit 254. The bottom end opening rim 256 of the dispensing unit 254 engages a housing 258 of cartridge unit 252, when the dispensing unit 254 and the cartridge unit 252 are assembled into a two-compartment container 250. The diameters of the bottom end opening rim 256 of housing 258 are such that they preferably engage to form a fluid-tight seal. In this illustrated example, housing 258 has an uplifted skirt 264 for engaging the rim of bottom end opening 256 for coupling cartridge unit 252 and dispensing unit 254. The mating surfaces of the rim 256 and skirt 264 may be provided with raised sealing ridges that produce friction-fitted seal at the mating interface. Alternatively, at least one of the mating surfaces may be provided with elastomeric seals to form compression seal at the mating interface. Alternatively, the dispensing unit 254 and the cartridge unit 252 may be configured with a variety of other structures to sealingly engage one another to form a fluid-tight seal. Housing 258 includes a sealing wall 272 surrounded by a plurality of wall openings 273 from the interior to the exterior of the housing.

Cartridge unit 252 further includes a displaceable sleeve 266 adapted for being axially displaced inside housing 264 between a sealed position and an unsealed position, and from the unsealed position back to the sealed position of the container assembly 250. A rim 270 of displaceable sleeve 266 is configured for sealing engagement with a sealing wall 272 of housing 258 thereby preventing fluid flow through wall openings 273. The bottom open end rim 268 of displaceable sleeve 266 is sealed with a second closure member 274. Thus, the bottom end of the dispensing unit 254 is sealed with cartridge unit 252, the top end opening of dispensing unit 254 is sealed with first closure member 262, and the bottom open end rim 268 of cartridge unit 252 is sealed with second closure member 274. According to the present embodiment, rim 270 of displaceable sleeve 266 and sealing wall 272 of housing 258 are configured and adapted to be coupled to one another when the dispensing unit 254 and the cartridge unit 252 are assembled together so that when a displaceable sleeve 266 is axially displaced downwardly (away from dispensing unit 254) to unseal the cartridge unit 252, a flow communication passage through wall openings 273 between the two assembly units is exposed.

Figure 5B:
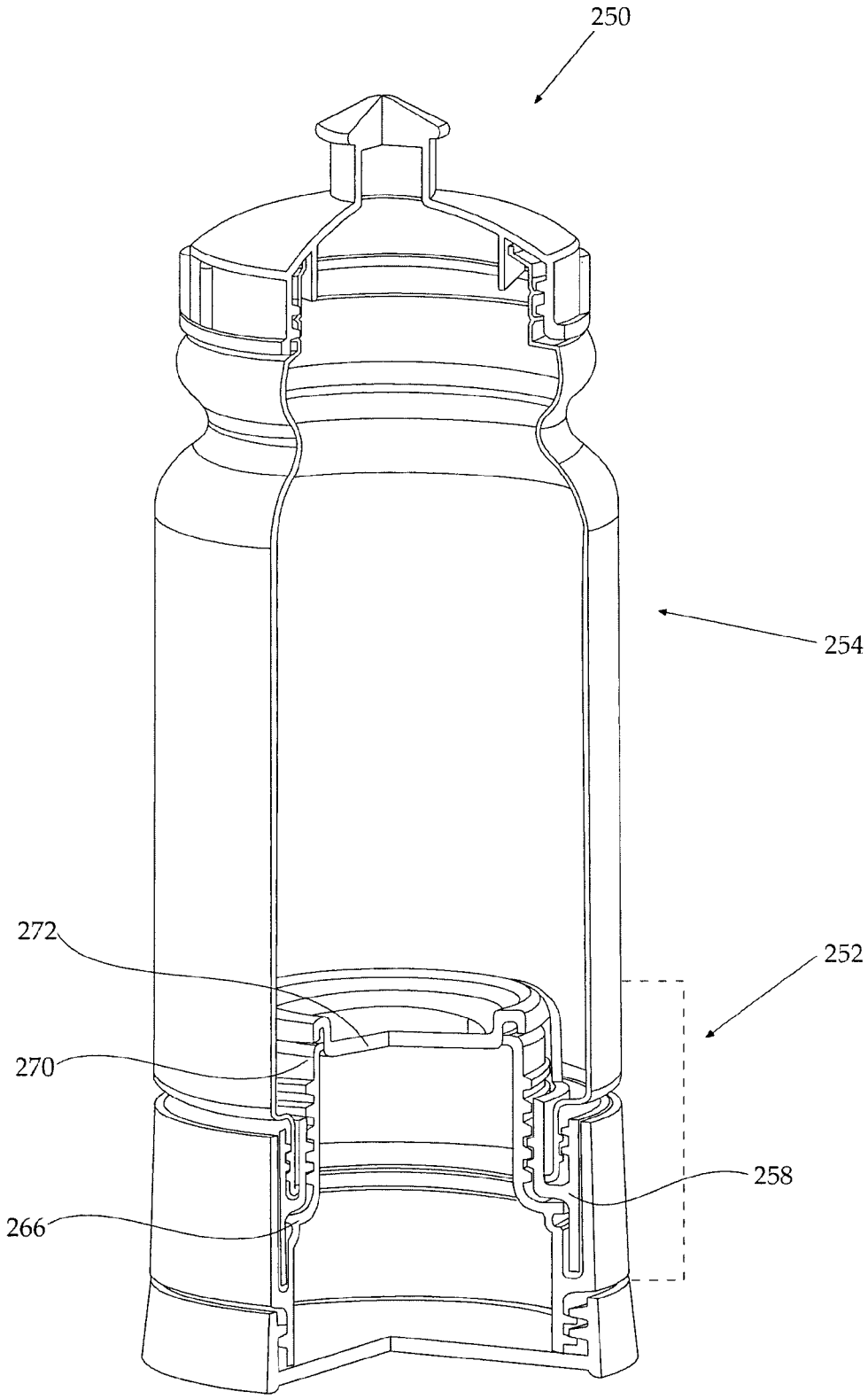
FIG. 5*b* is a partial cut away perspective view of the two-compartment container system of FIG. 5*a* in a sealing orientation.
Figure 5C:
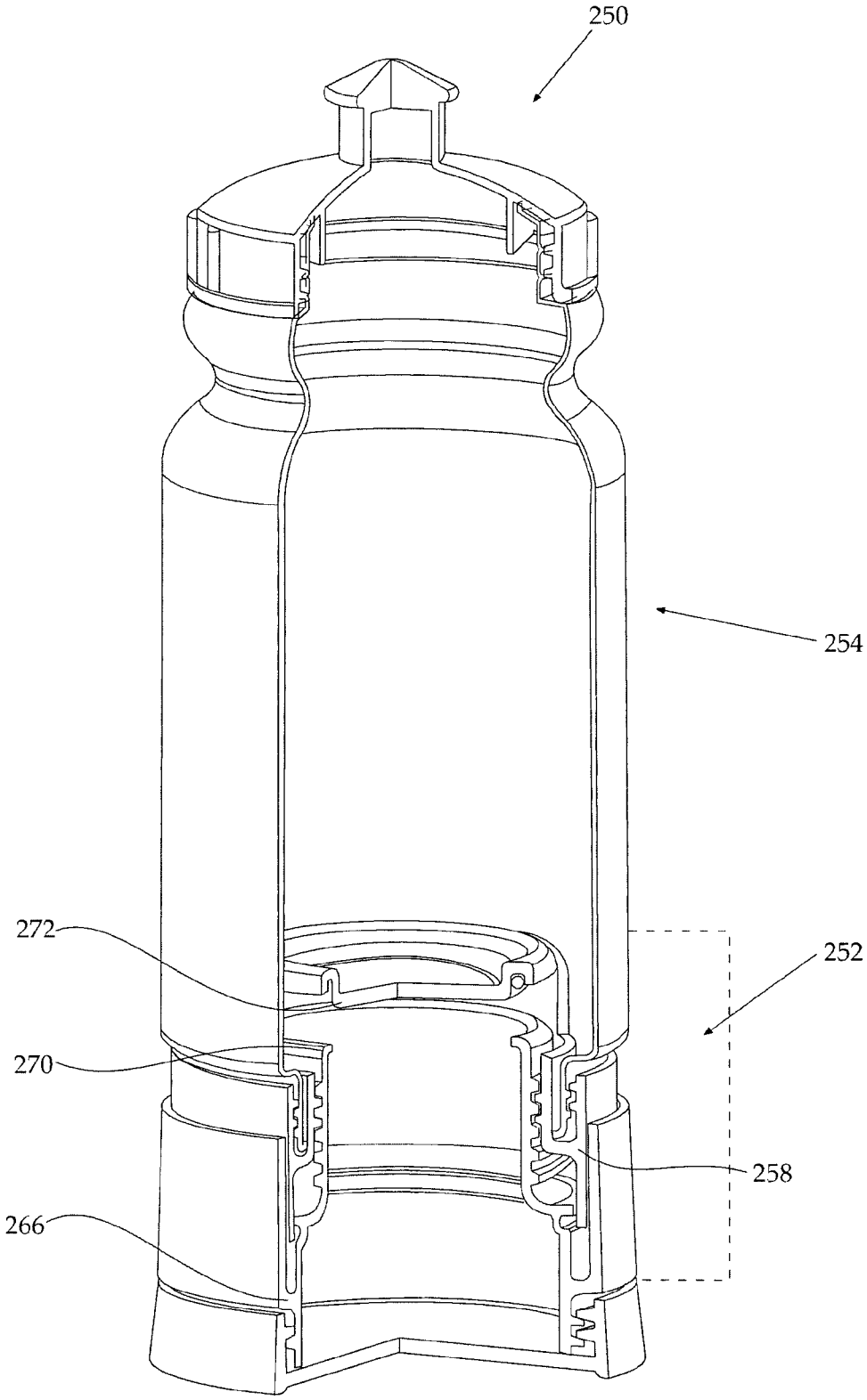
FIG. 5*c* is a perspective view of the two-compartment container system of FIGS. 5*a* and 5*b* in a flow communication orientation.

FIG. 5*b* is a partial cut away perspective view of the two-compartment container assembly 250 of FIG. 5*a* in a sealing orientation, where rim 270 of displaceable sleeve 266 sealingly engages sealing wall 272 of housing 258, preventing flow communication through wall openings 273. FIG. 5*c* is a partial cut away perspective view of the two-compartment container assembly 250 FIGS. 5*a* and 5*b* in a flow communication orientation, where rim 270 of displaceable sleeve 266 disengages from sealing wall 272 of housing 258, whereby wall openings 273 are uncovered to permit flow communication therethrough between the dispensing unit and the cartridge unit.

Figure 6:
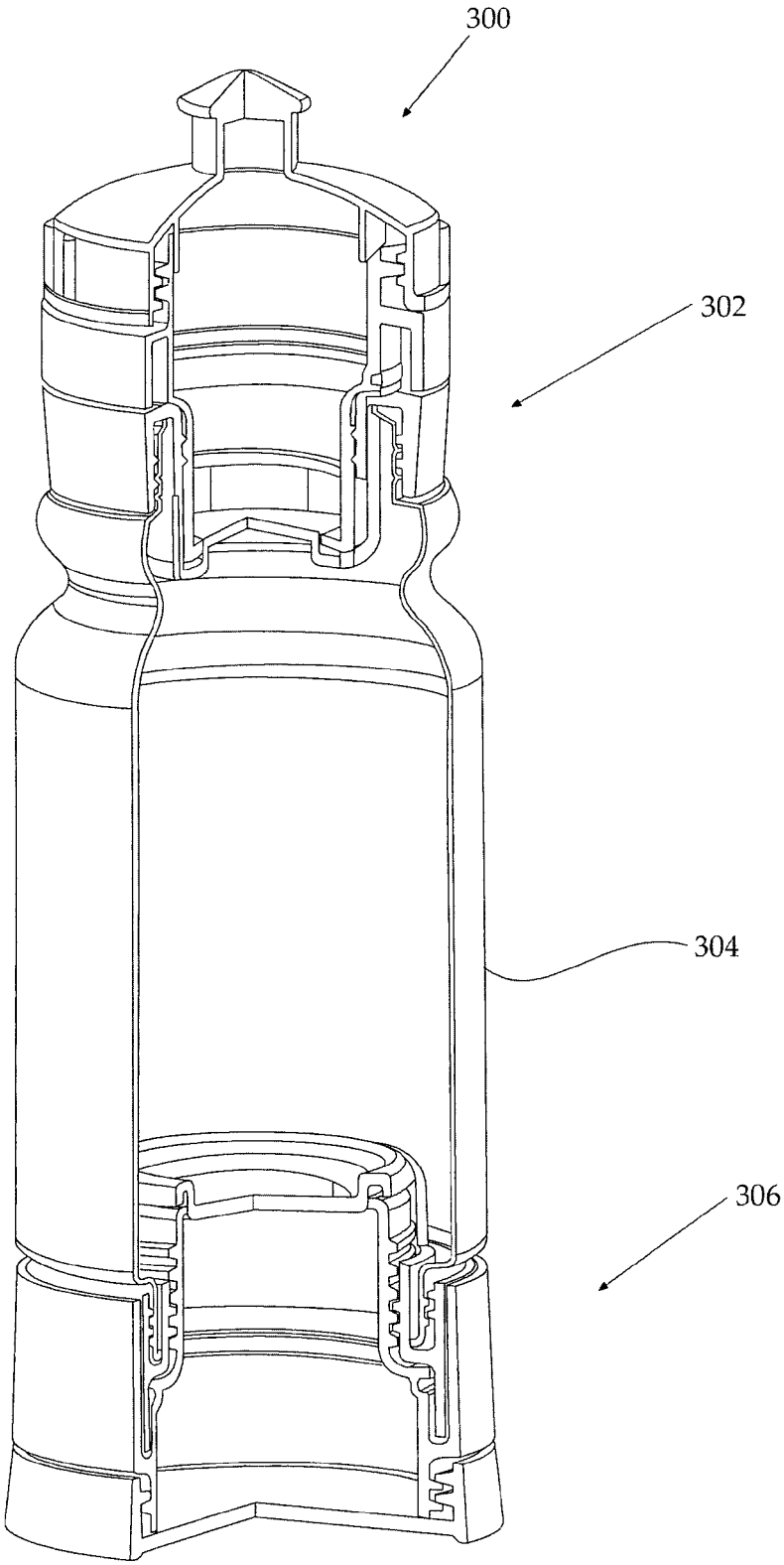
FIG. 6 is a partial cut away perspective view of a two-compartment container system constructed and operative in accordance with a further preferred embodiment of the present invention.

FIG. 6 is a partial cut away perspective view of a three-compartment container 300 assembly constructed and operative in accordance with a preferred embodiment of the present invention. Container assembly 300 includes a first cartridge unit 302, a dispensing unit 304 and a second cartridge unit 306. Dispensing unit 304 includes sealable openings at top and bottom ends. First cartridge unit 302 is sealingly coupled to the top open end of dispensing unit 304 and second cartridge unit 306 is sealingly coupled to the bottom open end of dispensing unit 304, thus forming a three-compartment container assembly. Each of these assembly units is an individually sealable container that may be filled with a component of a formulation that may be sealed and stored in them. Each of cartridge units 302 and 306 may be manipulated by the user to form a flow communication with the dispensing unit 304 for mixing the stored components, as desired.

Figure 12:
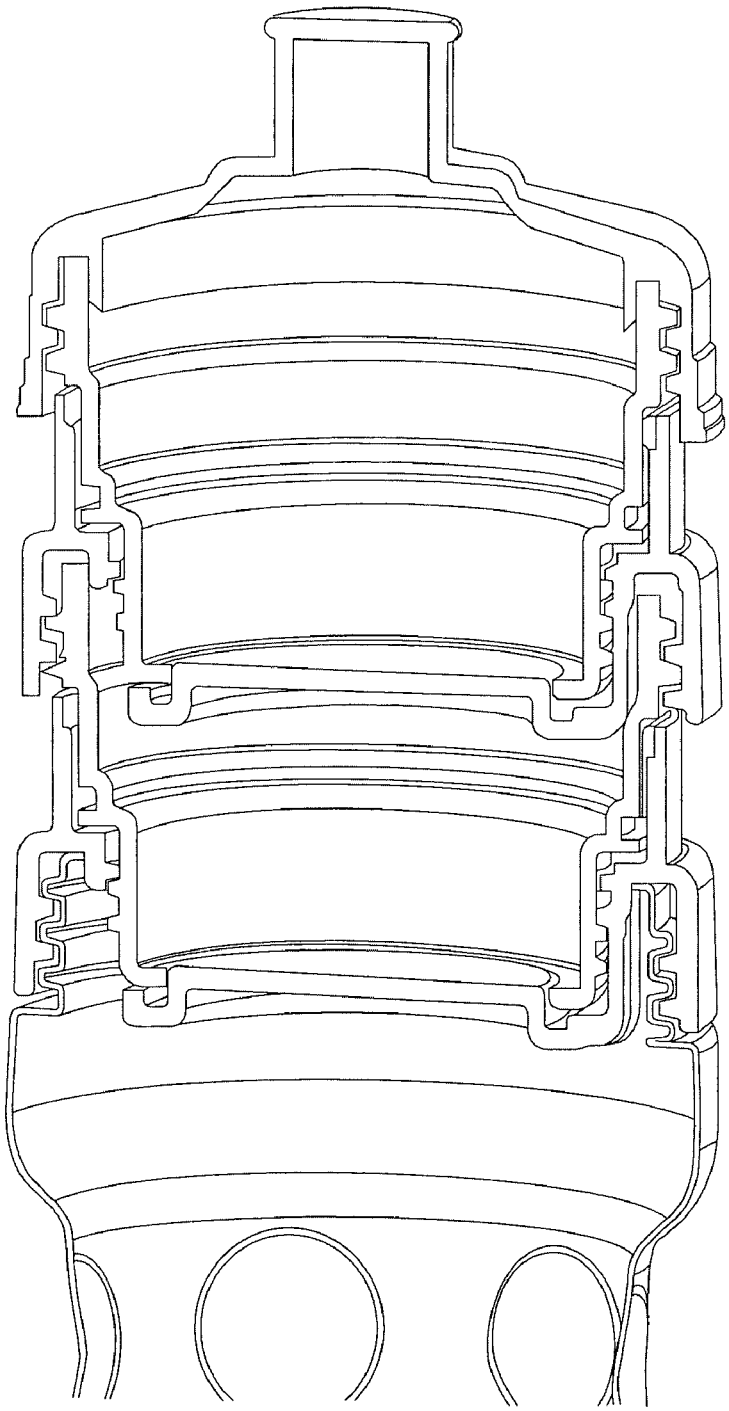
FIG. 12 is a partial cut away view of a three-compartment container system constructed and operative in accordance with another embodiment of the invention.

It will be appreciated that additional cartridge units may be piggy-backed to one another, in series, to form a multi-compartment system. In this configuration, the bottom end of the housing of the first cartridge unit and the top end of sleeve of the second cartridge unit engage each other to form a fluid-tight seal, so that each cartridge unit may form a compartment of a multi-compartment container system. One example is illustrated in FIG. 12, a partial cut away view of a three-compartment container system constructed and operative in accordance with one embodiment of the invention.

Figure 7B:
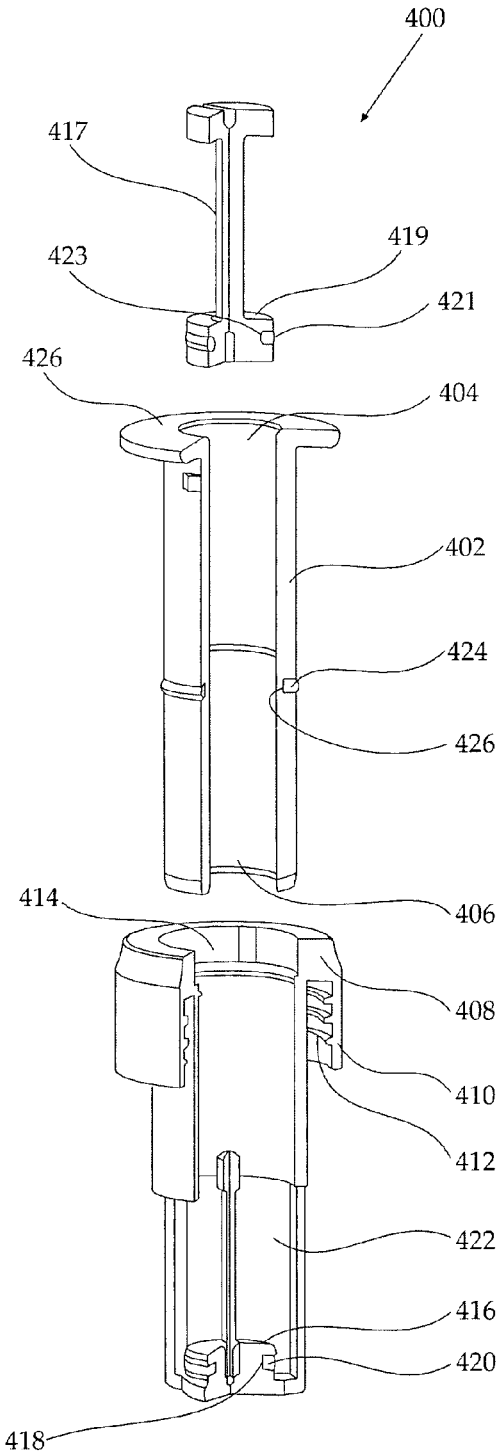
FIG. 7*b* is an exploded partial cut away perspective view of the two-compartment container system of FIG. 7*a;*
Figure 7A:
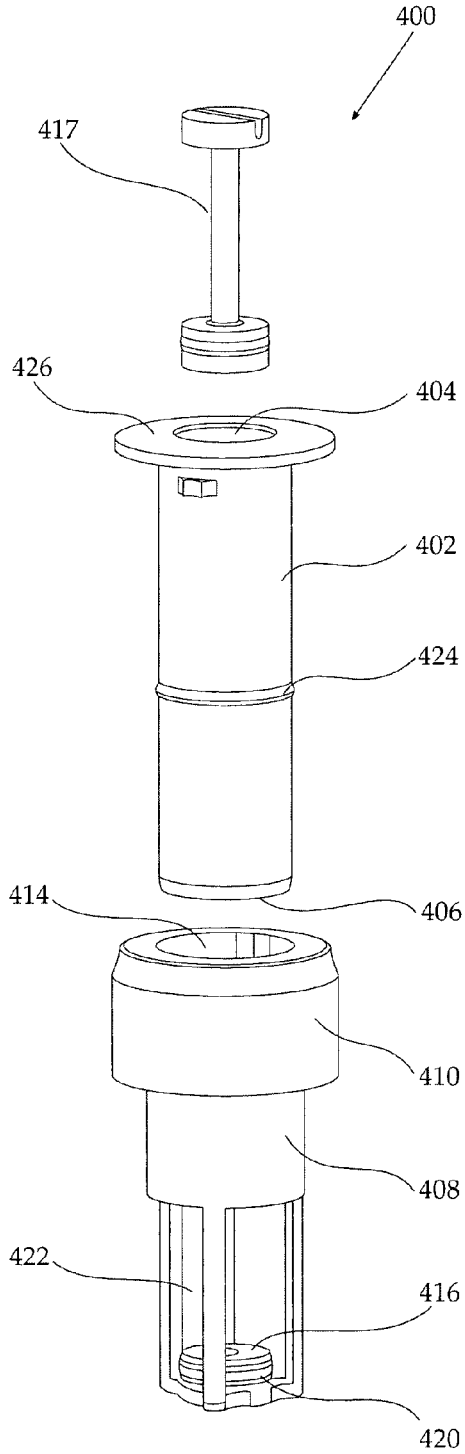
FIG. 7*a* is an exploded perspective view of a two-compartment container system constructed and operative in accordance with another preferred embodiment of the present invention.

In FIGS. 7*a* and 7*b*, there are shown a partial cutaway and plan exploded views of a cartridge unit 400, constructed and operative in accordance with a further preferred embodiment of the present invention. Cartridge 400 includes a cylindrical displaceable sleeve 402 with a sealable top opening 404 and a bottom opening 406. Cartridge unit 400 further includes a housing 408 having a depending skirt 410 arranged to engage the neck of a dispensing unit (not shown). When cartridge 400 is mounted on a dispensing unit, depending skirt 410 is coupled about the neck of the dispensing unit. The cartridge is adapted to be inserted into the compartment defined by the dispensing unit in the multi-compartment system (as seen in FIGS. 10 and 11 below.) The internal surface of depending skirt 410 is preferably provided with screw threads 412 for engaging complementary screw threads or a protruding flange on the dispensing unit, to couple the cartridge thereto. Alternatively, skirt 410 may include a beaded lip, which can produce a friction-fitting connection with the neck of the bottle or jar.

Displaceable sleeve 402 is sealingly mounted in housing 408. Sealable top opening 404 of displaceable sleeve 402 is used as a filling opening and is provided with a mating closure member 417. Closure member 417 is illustrated here as a bolt with an annular sealing flange 419 including an O-ring 421 seated in groove 423. Closure member 417 is adapted for insertion through sealable opening 404 and seals the top end opening of displaceable sleeve 402, as described in detail with reference to FIG. 8 below.

Housing 408 has, at one end, a closable opening 414 and, at the other end, a sealing wall 416 surrounded by a plurality of wall openings 422. Preferably, wall openings 422 extend substantially from sealing wall 416, so as to provide a large contact surface for mixing between components in the compartments in the cartridge and the dispensing unit, as soon as the sleeve disengages from the sealing wall, and can extend no further than the seal 424 between the sleeve and the housing. Displaceable sleeve 402 is adapted and configured to seal the closable opening 414 of housing 408. Sealing wall 416 includes a groove 418 about its circumference for receiving an o-ring 420, adapted for a sealing engagement with internal walls of displaceable sleeve 402. Thus, sealing wall 416 also serves as a partition for closing the bottom opening of displaceable sleeve 402 and defining a compartment in the displaceable sleeve 402 for holding the contents of cartridge 400. The compartment can hold any desired component of a mixture which will later be mixed with a component, typically a liquid, in the bottle, and can include a free flowing powder, a solid or a viscous or pasty compound, or a liquid.

The lower portion of housing 408 defines a plurality of side wall openings 422 for providing flow passages for flow communication between the compartment in the cartridge and the bottle or jar, when the cartridge is coupled to the bottle.

The displaceable sleeve is axially displaceable between two positions along a longitudinal axis through the cartridge, a first position whereby the seal is formed, as o-ring 420 about the circumference of the sealing wall 416 sealingly engages the internal walls of the displaceable sleeve 402, and a second position where the sealing base plate and the displaceable sleeve are disengaged and side walls openings 422 are unobstructed and provide flow passages, whereby the compartment inside the cartridge is in flow communication with the bottle through walls openings 422. The flow communication allows mixing of the substances separately stored in the dual container assembly of the present invention.

As illustrated, displaceable sleeve 402 preferably is provided with an additional sealing o-ring 424 seated in a groove 426 in the external wall of displaceable sleeve 402, which provides a fluid-tight sliding seal between the displaceable sleeve and the internal walls of the housing so that the mixture in the container assembly does not leak when displaceable sleeve 402 is in the unsealed position (as illustrated below in FIG. 11). It will be appreciated that seal 424 can be fabricated of elastomeric material for enhanced sealing and preferably is air-permeable. O-ring 424 also stabilizes the movement of displaceable sleeve 402 during the unsealing step, preventing the displaceable sleeve from wobbling with respect to the longitudinal axis of the cartridge.

The upper portion of displaceable sleeve 402 forms an annular flange 426. The annular flange 426 is adapted and configured to be controlled by a user to axially displace the displaceable sleeve. The filling opening 404 of the sleeve may typically be sealed by closure member 417 so that the cartridge's content can be protected from contamination during storage.

Figure 8:
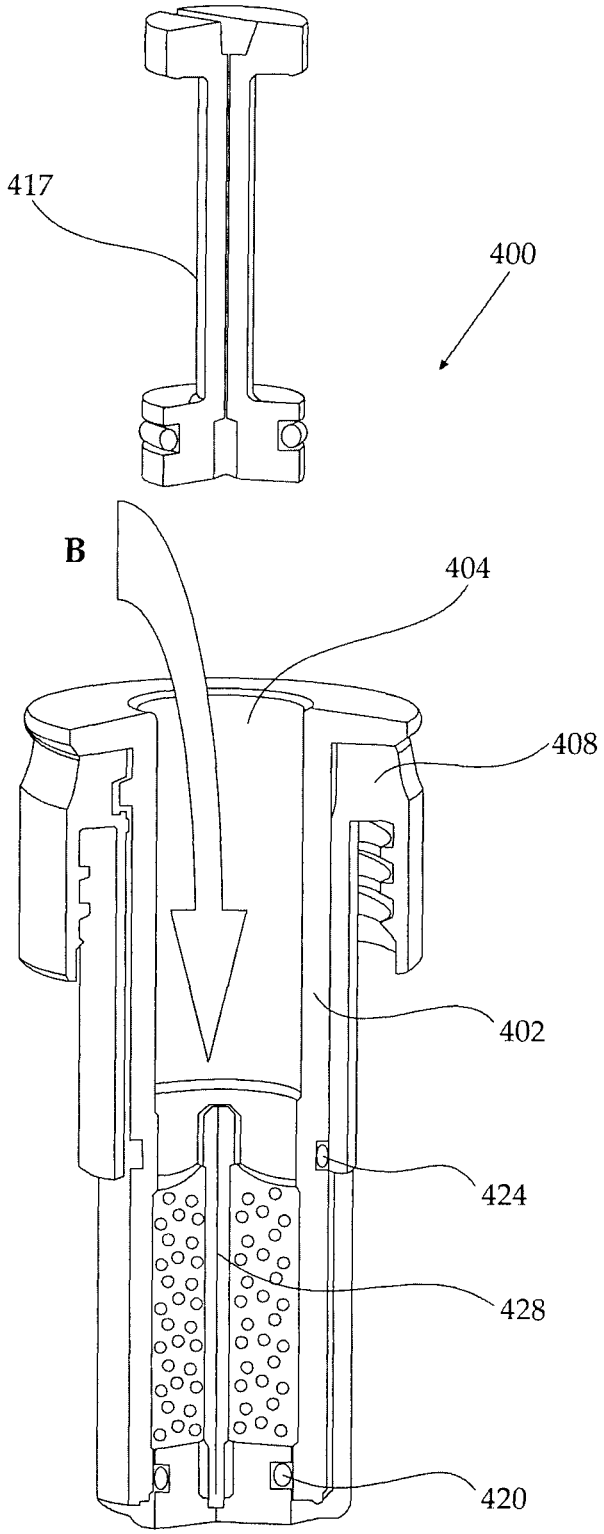
FIG. 8 is a partial cutaway view of the cartridge unit of FIGS. 7*a* and 7*b* during assembly and filling.

Referring now to FIG. 8, there is shown a partial cutaway view of cartridge 400, illustrating assembly and filling of the cartridge. Displaceable sleeve 402 is inserted in housing 408 until the internal walls of the lower end of displaceable sleeve 402 sealingly engage sealing wall 416, and particularly O-ring 424. Housing 408 further includes a bolt 428. The lower end of bolt 428 is coupled to sealing wall 416 and the upper end of bolt 428 is adapted and configured to engage the bottom end of closure member 417. The upper end of bolt 428 is provided with threads and the bottom end of closure member 417 is provided with complementary threads for threading engagement therebetween.

Figure 9:
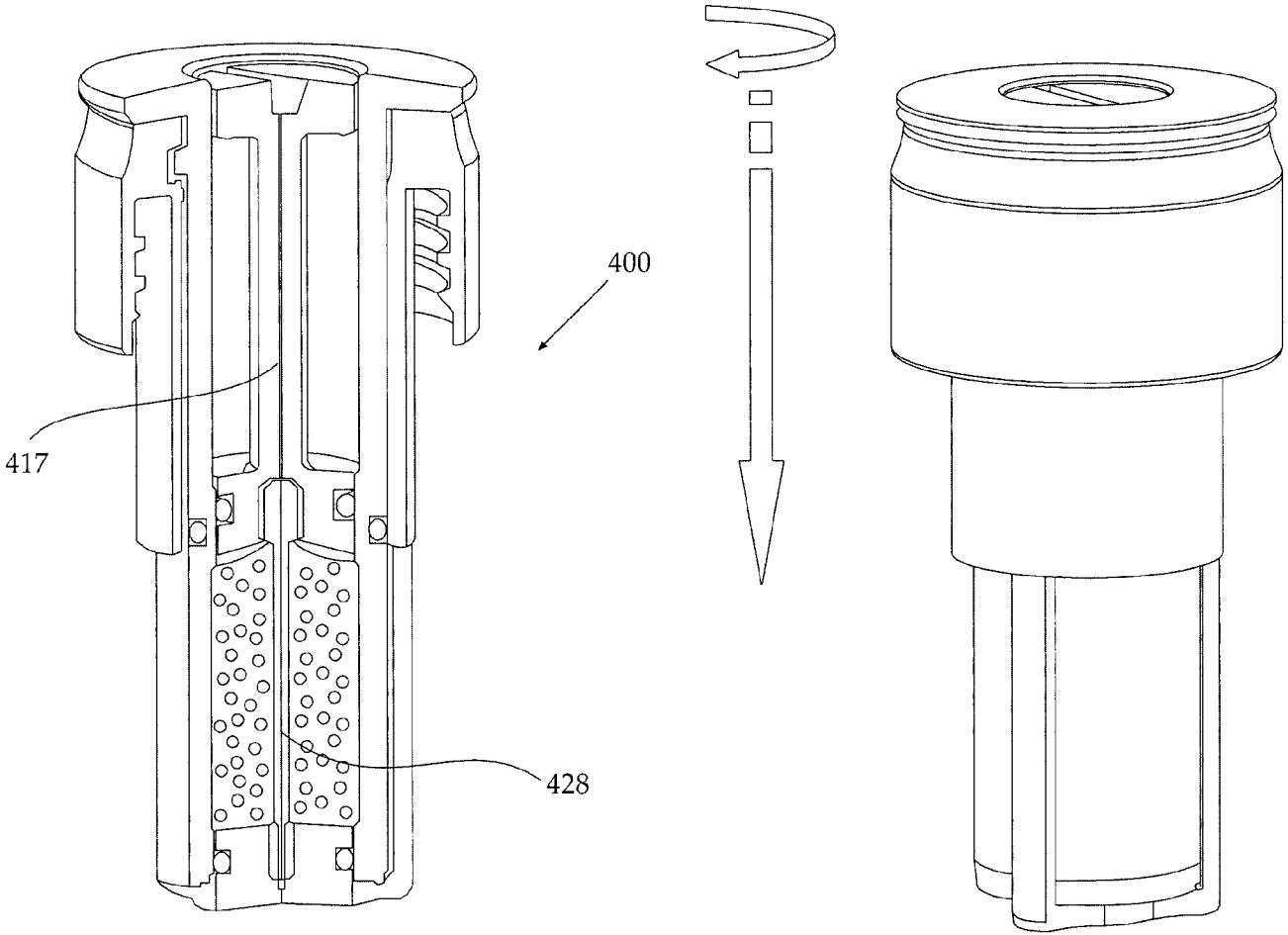
FIG. 9 is a partial cutaway view of the cartridge unit of FIGS. 7*a* and 7*b* as assembled to form a compartment, with its top cover closed.

The present invention also provides a process for preparing a cartridge for holding and storing a component of a mixture separately from a component in the bottle, until the cartridge is mounted on the bottle and their contents mixed. The process includes: (a) providing a cartridge having a cylindrical housing having an opening at its top end, a sealing plate at its bottom end and walls openings adjacent the sealing plate; (b) placing a displaceable sleeve within the housing, the displaceable sleeve having a bottom opening adapted to form a seal with the sealing plate for closing the bottom opening of the displaceable sleeve, which is displaceable between a sealed position and an unsealed position; the displaceable sleeve having a sealable filling opening at its top end and a complementary closure member; the displaceable sleeve being placed in the cartridge in the sealed position; (c) introducing one component of a mixture into cartridge 400 through the sealable filling opening of the displaceable sleeve (all as illustrated in FIG. 8); and (d) sealing the sealable filling opening by inserting closure member 417 into the displaceable sleeve until it threadably engages bolt 428, as illustrated in FIG. 9.

In a typical intended use, a cartridge 400 would be inserted into the top of a bottle 430 or jar, as illustrated in FIG. 10. In the illustrated embodiment, cartridge 400 is screwed onto the threaded neck of bottle 430, as in conventional screw tops. The bottle may be capped without breaking the seal formed by sealing plate 420, and may be used to store the components in separate compartments. Later, as illustrated in FIG. 11, the annular flange 426 may be lifted to controllably release the seal between sealing plate 420 and displaceable sleeve 402, to allow a flow-communication between the compartment in the cartridge and the bottle to mix the components to form the mixture.

Figure 13A:
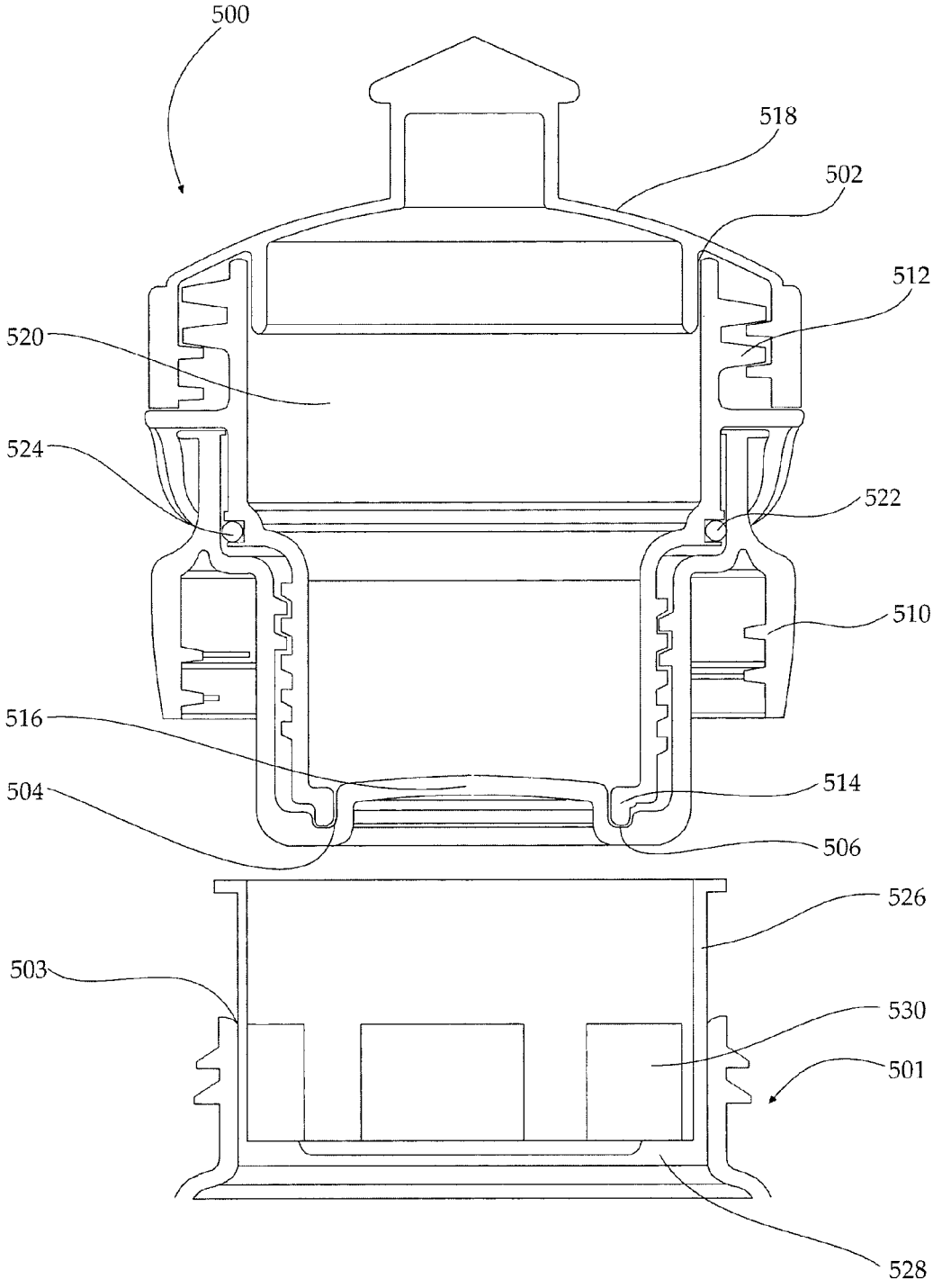
FIG. 13*a* is a partial cut away perspective view of a two-compartment container system in an unassembled orientation according to another embodiment of the invention.
Figure 13B:
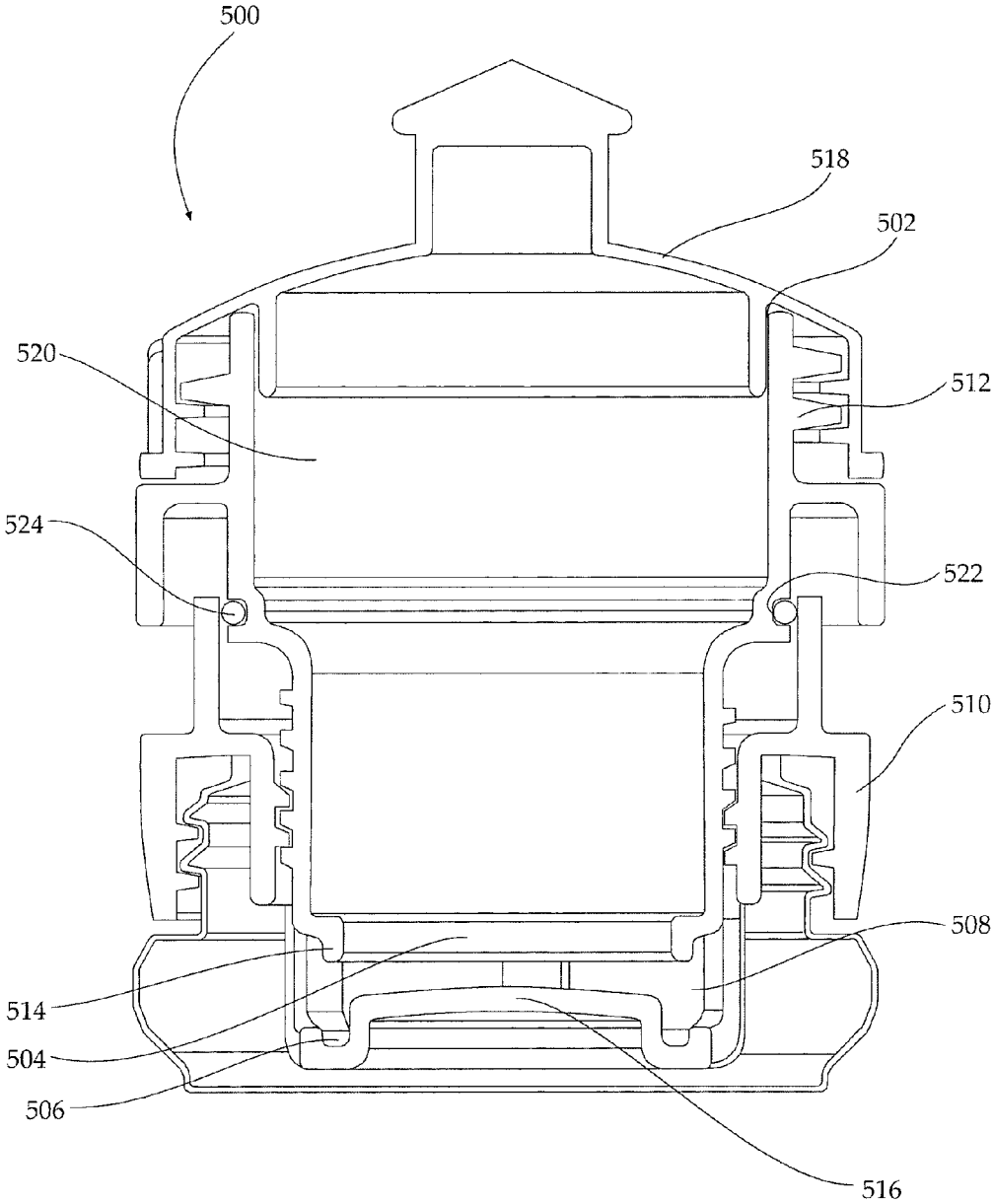
FIG. 13*b* is a partial cut away perspective view of the cartridge unit according to FIG. 13*a*, in a flow communication orientation.

Referring now to FIGS. 13*a* and 13*b*, there are shown partial cutaway perspective views of a cartridge unit 500, constructed and operative in accordance with a further embodiment of the invention, in a sealed and an unsealed orientation, respectively. Cartridge unit 500 may be assembled with a dispensing unit 501 to form a two-compartment container. The cartridge unit 500 has two openings: a top opening 502 and a bottom opening 504. The top opening 502 is defined by a displaceable sleeve 512 sealingly disposed in a housing 510. The displaceable sleeve 512 is normally sealingly situated within cartridge unit housing 510 and is axially displaceable within housing 510 between a sealed position and an unsealed position. Preferably, the external wall of the sleeve 512 adjacent the top portion of housing 510 is provided with a circumferential recess 522 for seating an o-ring seal 524. This arrangement provides a liquid-tight seal for sealed sliding engagement between the external wall surface of displaceable sleeve 512 and internal wall of housing 510. In this way, the mixture held in the two-compartment container assembly 500 does not leak when displaceable sleeve 512 is in the unsealed or sealed position.

The bottom portion of displaceable sleeve 512 defines a depending skirt 514 adapted and configured for sealing engagement with a sealing wall 516 at the bottom end of housing 510 to seal the bottom opening 504 of the cartridge unit 500. Sealing wall 516 is surrounded by a circumferential groove 506 for sealingly receiving depending skirt 514. In this embodiment, depending skirt 514 is sealingly affixed in groove 506 at the time of manufacture, so that no additional sealing element is required between the bottom of the sleeve and the sealing wall. When the sleeve is displaced to the unsealed orientation, the skirt is arranged to break away from the groove, as described in detail below. Alternatively, the sleeve can be integrally formed with the sealing wall but define frangible areas therebetween, permitting the sleeve to be broken away from the sealing wall when the sleeve is displaced relative to the housing to the unsealed orientation.

A plurality of side wall openings 508 (seen in FIG. 13*b*) are defined in the side walls of the lower portion of housing 510. These side wall openings are blocked when displaceable sleeve 512 is in the sealed orientation of FIG. 13*a* and are exposed as soon as displaceable sleeve 512 disengages from sealing wall 516. However, it will be appreciated that the sealing engagement of displaceable sleeve 512 and sealing wall 516 seals the bottom portion of cartridge unit 500 irrespective of whether side wall openings 508 are sealed by the external walls of displaceable sleeve 512. Thus, sealing wall 516 of housing 510 and displaceable sleeve 512 define a compartment 520 within cartridge unit 500.

The top opening 502 may be sealed with a top closure member 518. Preferably, the seal formed at the top opening 502 by the closure member 518 is also fluid-tight, so that compartment 520 of the cartridge unit may be filled with either liquid or solid substances. The closure member 518 may be any suitable closure member.

In FIG. 13*b*, the displaceable sleeve 512 has been axially displaced within housing 510 from a sealed position to an unsealed position. In its unsealed position (as shown in FIG. 13*b*), the displaceable sleeve 512 is axially displaced from sealing wall 516 and skirt 514 has broken away from groove 506, leaving side wall openings 508 exposed, thus providing flow communication passages between compartment 520 and the internal space of the dispensing unit 501. The flow communication allows mixing of a component in compartment 520 with a component in dispensing unit 501 to form a mixture which is ready for dispensing.

It will be appreciated that the axial displacement of displaceable sleeve 512 can be achieved by rotating closure member 518 in the tightening direction of the cap when the displaceable sleeve and the housing are threadably engaged or by pulling closure member 518 when the portion of engagement of the displaceable sleeve and the housing are not threaded and they are frictionally engaged. Alternatively, displaceable sleeve 512 can be axially displaced between the sealed position and the unsealed position and from the unsealed position back to the sealed position, in any other suitable manner, e.g., by turning clockwise or counter clockwise, or pulling or pushing closure member 518.

In the embodiment illustrated in FIG. 13*a*, a dispensing unit closure element 526 is provided in the neck portion of dispensing unit 501, in a sealing orientation. Dispensing unit closure element 526 includes a bottom seal element 528 for sealing the top opening 503 of the dispensing unit. Dispensing unit closure element 526 also includes one or more side openings 530 which are adapted to communicate with the inside space of dispensing unit 501 when the dispensing unit closure element 526 is displaced such that bottom seal element 528 disengages the neck portion 503 and moves into the dispensing unit. Alternatively, dispensing unit closure element 526 can merely be a laminated or frangible closure element, which can be partially torn or disengaged from the neck when cartridge unit 500 is inserted into dispensing unit 501 during assembling of the two-compartment container according to the present invention.

In the above embodiments, the bottom portion of the displaceable sleeve defines an opening which forms a seal when it engages the sealing wall of the housing only in the sealed orientation. According to further embodiments of the invention, described below, the bottom portion of the displaceable sleeve has its own seal, which is adapted and configured to fixedly engage the sealing wall of the housing and is detachable or frangible at the time of displacement of the sleeve. Such a structure is particularly suited for use with disposable cartridges, which do not require re-sealing for further use after unsealing.

Figure 14A:
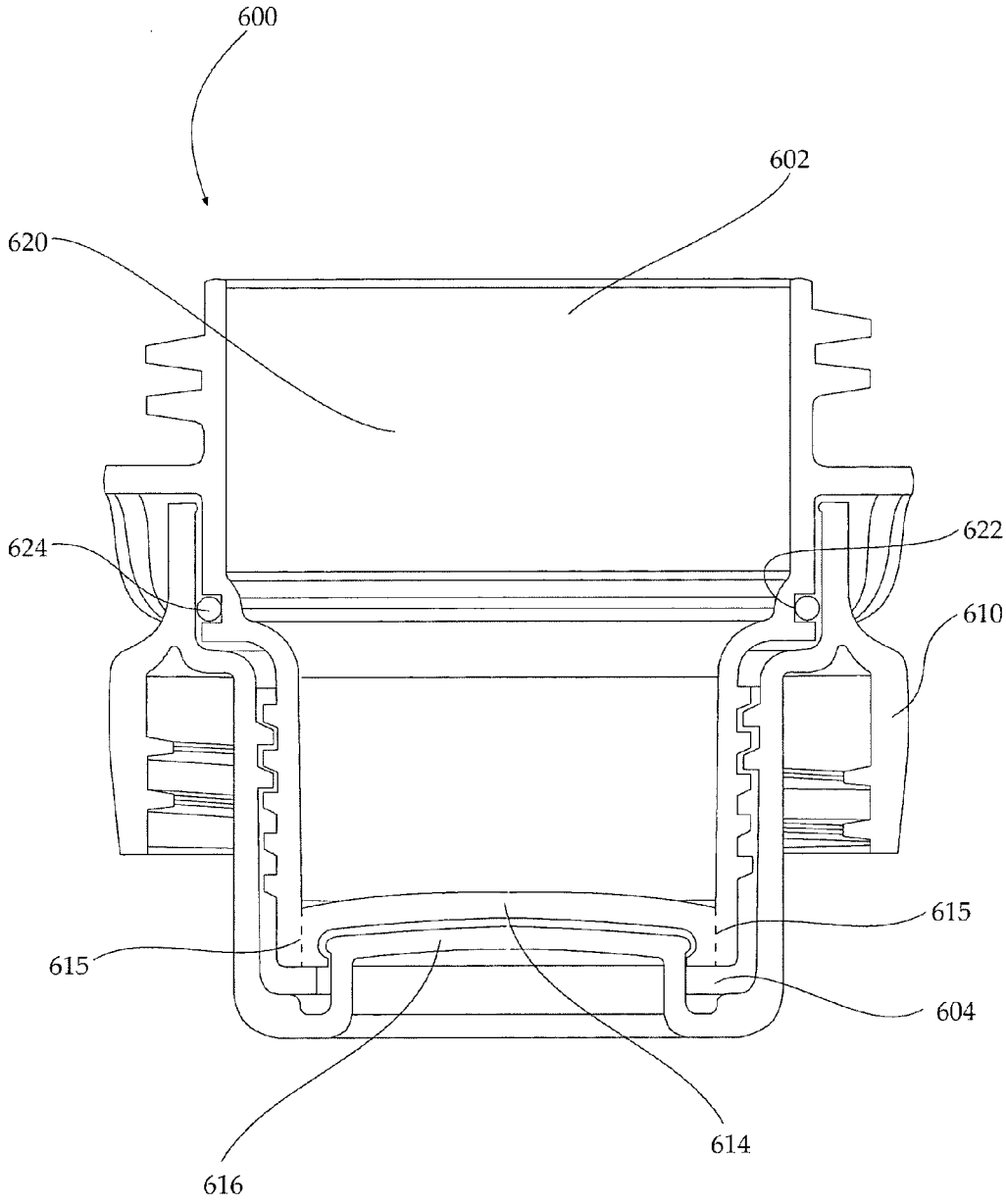
FIG. 14*a* is a partial cut away perspective view of a cartridge unit according to yet another embodiment of the invention, in a sealing orientation.
Figure 14B:
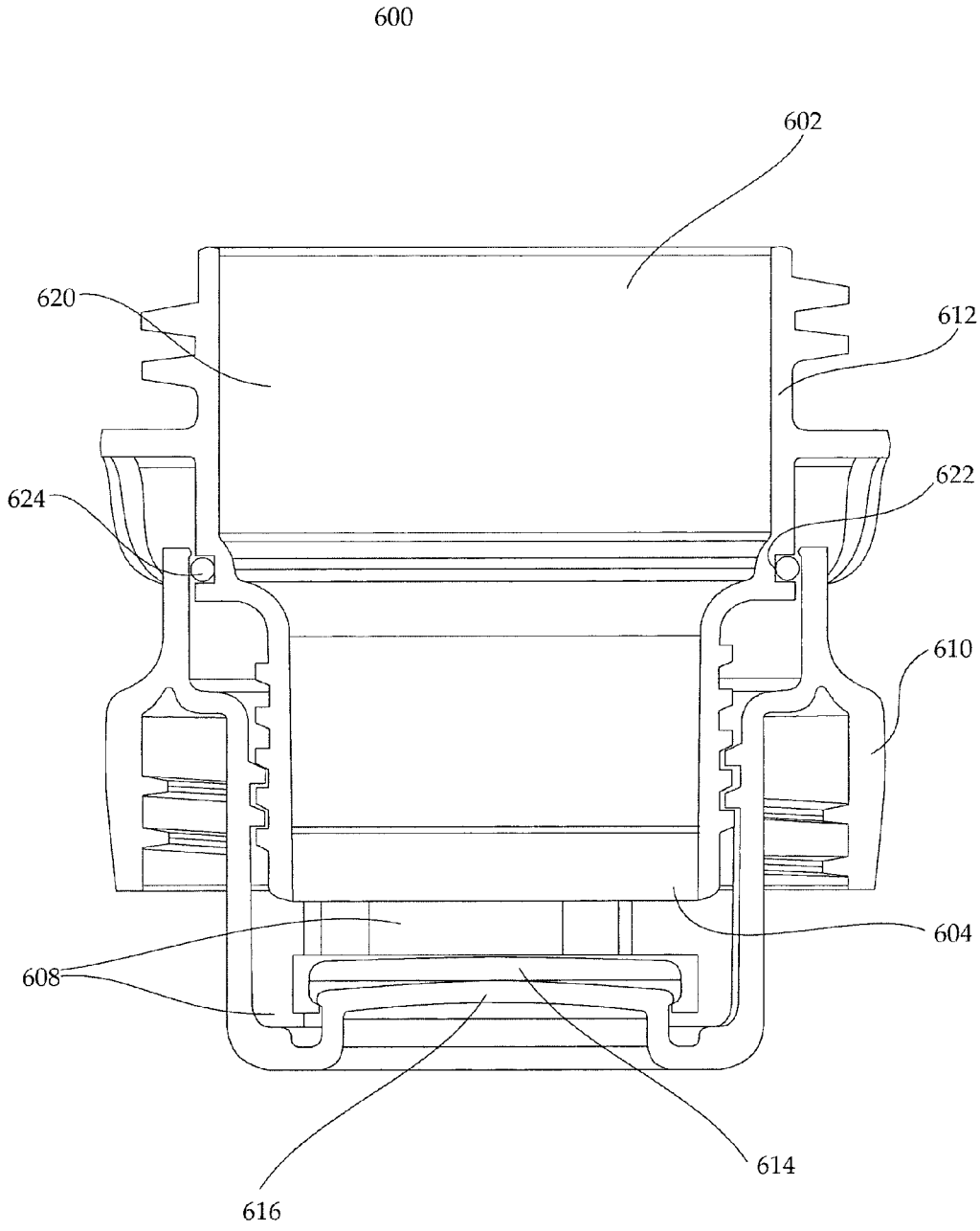
FIG. 14*b* is a partial cut away perspective view of the cartridge unit of FIG. 14*a* in a flow communication orientation.

Referring now to FIGS. 14*a* and 14*b*, there are shown partial cut away perspective views of a cartridge unit 600 according to another embodiment of the invention, in respective sealing and unsealed orientations, for use as described above. Cartridge unit 600 may be engaged with a dispensing unit (not shown) to form a two-compartment container. The cartridge unit 600 has two openings: a top opening 602 and a bottom opening 604. The top opening 602 is defined by a displaceable sleeve 612 sealingly disposed in a housing 610. The displaceable sleeve 612 is normally situated within cartridge unit housing 610 and is axially displaceable within housing 610 between the sealed position illustrated in FIG. 14*a* and an unsealed position illustrated in FIG. 14*b*. Preferably, the external wall of the sleeve 612 adjacent the top portion of housing 610 is provided with a circumferential recess 622 for seating an o-ring seal 624. This arrangement provides a liquid-tight seal for sealed sliding engagement between the external wall surface of displaceable sleeve 612 and internal wall of housing 610.

Sleeve 612 further defines a detachable sealed bottom 614, integrally formed with the sleeve, adapted and configured for fixed, snap fit engagement with a sealing wall 616 at the bottom end of housing 610 to seal the bottom opening 604 of the cartridge unit 600. Sealed bottom 614 is detachable along a pair of scored or weakened areas 615 to facilitate ease of detachment when sleeve 612 is displaced away from sealing wall 616. It will be appreciated that the detachable sealed bottom 614 may define a seal adapted and configured for sealing and frictional fixing in the internal walls of the bottom end opening of the displaceable sleeve. It will be further appreciated that detachable sealed bottom 614 may be detachably attached to the bottom end opening of the displaceable sleeve in a variety of attaching methods that would be obvious to one of ordinary skill in the art.

Sealing wall 616 may be configured for receiving the detachable sealed bottom 614 or may include complementary engagement elements for permitting snap fit or other fixed engagement between detachable sealed bottom 614 and sealing wall 616. Thus, both the sealing wall and the sleeve must be configured for complementary fixed engagement between them.

A plurality of side wall openings 608 (seen in FIG. 14*b*) are defined in the side walls of the lower portion of housing 610. These side wall openings are blocked when displaceable sleeve 612 is in the sealed orientation of FIG. 14*a*. It will be appreciated that, in this embodiment, when sleeve 612 is displaced relative to housing 610, the detachable sealed bottom 614 of displaceable sleeve 612 detaches from the sleeve 612 and remains engaged to sealing wall 616. In this way, side wall openings 608 are exposed, allowing flow communication between the cartridge unit and the dispensing unit. The flow communication allows mixing of a component in cartridge unit 600 with a component in the dispensing unit (partially shown in FIG. 13*a*) to form a mixture which is ready for dispensing.

It will be appreciated that the sealing engagement of displaceable sleeve 612 and sealing wall 616 seals the bottom portion of cartridge 600, irrespective of whether side wall openings 608 are sealed by displaceable sleeve 612. Thus, sealing wall 616 of housing 610 and displaceable sleeve 612 define a compartment 620 within cartridge unit 600.

The top opening 602 may be sealed with a top closure member (not shown). Preferably, the seal formed at the top opening 602 by the closure member is also fluid-tight, so that compartment 620 of the cartridge unit may be filled with either liquid or solid substances. This arrangement also protects the contents of the cartridge unit from contamination during storage. The closure member may be a screw cap, a friction fitting plug, a snap-fitting plug, a heat-sealed membrane, or another variety of closure methods that would be obvious to one of ordinary skill in the art.

It will be appreciated that the axial displacement of displaceable sleeve 612 can be achieved by the rotating closure member in the tightening direction of the cap when the displaceable sleeve and the housing are threadably engaged or by pulling the closure member when the portion of engagement of the displaceable sleeve and the housing are not threaded and they are frictionally engaged. Alternatively, displaceable sleeve 612 can be axially displaced between the sealed position and the unsealed position and from the unsealed position back to the sealed position, in any other suitable manner.

It will further be appreciated that the sleeve can be frangible at any location along its lower walls, such that detachable portion 614 can disengage along the internal wall of the sleeve or through a side wall of the sleeve, as desired.

It will be appreciated that the above descriptions are intended only to serve as examples and that many other embodiments are possible and encompassed within the spirit and the scope of the present invention. The caps described herein and illustrated in the figures are examples only. Caps embodying other variations of the structures described here are within the scope of the present invention.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A cartridge for use in a multi-compartment system, the cartridge comprising:

a housing having an opening at a top end, a sealing wall at a bottom end and wall openings through side walls of the housing;

a displaceable sleeve sealingly mounted in said housing, said displaceable sleeve having a sealable filling opening at its top end, and a detachable seal at its bottom end adapted and configured for fixed engagement with said sealing wall;

said displaceable sleeve being axially displaceable between two positions along a longitudinal axis through the cartridge, a first position whereby said detachable seal is fixedly engaged with said sealing wall, and a second position where said detachable seal is detached from said displaceable sleeve, permitting flow communication through said wall openings.

2. The cartridge according to claim 1, wherein said detachable seal is integrally formed having frangible portions.

3. The cartridge according to claim 1, wherein said sealing wall and the sleeve are configured for complementary fixed engagement between them.

4. The cartridge according to claim 1, wherein said sealing wall and said sleeve are configured for fixed snap fit engagement.

5. The cartridge according to claim 1, wherein said sealing wall is sealingly affixed to said displaceable sleeve in said first position and breaks away from said displaceable sleeve in said second position.

6. The cartridge according to claim 1, wherein said sealing wall is integrally formed with said displaceable sleeve in said first position and breaks away from said displaceable sleeve in said second position.

7. A multi-compartment system for storing and mixing two components of a mixture and mixing the components prior to use, the system comprising:

at least two containers;

at least one of the containers being a cartridge, the cartridge comprising:

a housing having an opening at a top end, a sealing wall at a bottom end and wall openings through side walls of the housing, the cartridge being adapted and configured to engage and seal the second container;

a displaceable sleeve sealingly mounted in said housing, said displaceable sleeve having a sealable filling opening at its top end, and a detachable seal at its bottom end adapted and configured for fixed engagement with said sealing wall;

said displaceable sleeve being axially displaceable between two positions along a longitudinal axis through the cartridge, a first position whereby said detachable seal is fixedly engaged with said sealing wall, and a second position where said detachable seal is detached from said displaceable sleeve, whereby the compartment inside the cartridge is in flow-communication with a compartment in said second container through said wall openings.

8. The system according to claim 7, wherein said wall openings extend substantially from said sealing wall.

9. The system according to claim 7, wherein said cartridge is adapted to sit at least partially inside a second of said at least two containers.

10. The system according to claim 9, wherein said housing of said cartridge is adapted to sit with said wall openings inside a compartment defined in said second container.

11. The system according to claim 7, comprising at least three containers.

12. The system according to claim 11, wherein one of said at least three containers is a dispensing unit having two open ends, and a cartridge unit is mounted on each end of said dispensing unit.

13. The system according to claim 11, wherein at least two of said containers are cartridge units coupled to one another.

14. The system according to claim 7, wherein said sealing wall is sealingly affixed to said displaceable sleeve in said first position and breaks away from said displaceable sleeve in said second position.

15. The system according to claim 7, wherein said sealing wall is integrally formed with said displaceable sleeve in said first position and breaks away from said displaceable sleeve in said second position.

16. A method for forming a cartridge comprising:

providing a housing having an opening at a top end, a sealing wall at a bottom end and wall openings through side walls of said housing;

sealingly mounting a displaceable sleeve in said housing, said displaceable sleeve having a sealable filling opening at its top end, and a detachable seal at its bottom end adapted and configured for fixed engagement with said sealing wall;

disposing said displaceable sleeve to be axially displaceable between two positions along a longitudinal axis through the cartridge, a first position whereby said displaceable sleeve fixedly engages said sealing wall, and a second position where said detachable seal is detached from said displaceable sleeve, permitting flow communication through said wall openings.

17. The method according to claim 16 further comprising:

providing two containers, wherein at least one of the containers is said cartridge coupling said cartridge to a second of said at least two containers;

and disposing said displaceable sleeve for axial displacement between two positions along a longitudinal axis through the cartridge, a first position whereby said displaceable sleeve fixedly engages said sealing wall, thereby defining a compartment inside said cartridge, and a second position where said detachable seal is detached from said displaceable sleeve, permitting flow communication through said wall openings between said containers, so as to form a multi-compartment system for storing two components of a mixture and mixing the components prior to use.

18. The method according to claim 17, further comprising inserting at least part of said cartridge into said second container, the cartridge being adapted and configured to engage and seal said second container when at least said wall openings of said housing are inside said compartment defined by said second container.

* * * * *